United States Patent [19]

Satomi

[11] 4,316,760

[45] Feb. 23, 1982

[54] BINDING MACHINE

[75] Inventor: Hitoshi Satomi, Sayama, Japan

[73] Assignee: Nichiban Kabushiki Kaisha, Tokyo, Japan

[21] Appl. No.: 215,276

[22] Filed: Dec. 11, 1980

Related U.S. Application Data

[63] Continuation of Ser. No. 56,074, Jul. 9, 1979, abandoned.

[30] Foreign Application Priority Data

Jul. 12, 1978 [JP] Japan ..... 53-84835

[51] Int. Cl.[3] ..... B65C 1/00

[52] U.S. Cl. ..... 156/468; 53/580; 100/8; 100/17; 100/20; 156/492; 156/494; 156/510; 156/522

[58] Field of Search ..... 156/6, 8, 16, 17, 20, 156/29, 459, 468, 475, 483–485, 492, 494–496, 510, 522; 53/582, 580, 583, 135

[56] References Cited

U.S. PATENT DOCUMENTS

| | | | |
|---|---|---|---|
| 2,145,339 | 1/1939 | Burns | 100/17 X |
| 3,141,277 | 10/1964 | Johnston | 53/135 X |
| 3,389,039 | 6/1968 | Steckler | 156/468 X |
| 3,611,916 | 9/1971 | Valan | 100/4 |

*Primary Examiner*—David A. Simmons

*Attorney, Agent, or Firm*—Stevens, Davis, Miller & Mosher

[57] ABSTRACT

A binding machine having a base and a binding arm pivoted to the base, for tightly binding articles to be inserted between the base and the binding arm with an adhesive tape which is fed from a tape reel to a tip portion of the binding arm, by swinging down the binding arm toward the base.

12 Claims, 36 Drawing Figures

FIG. 3.A
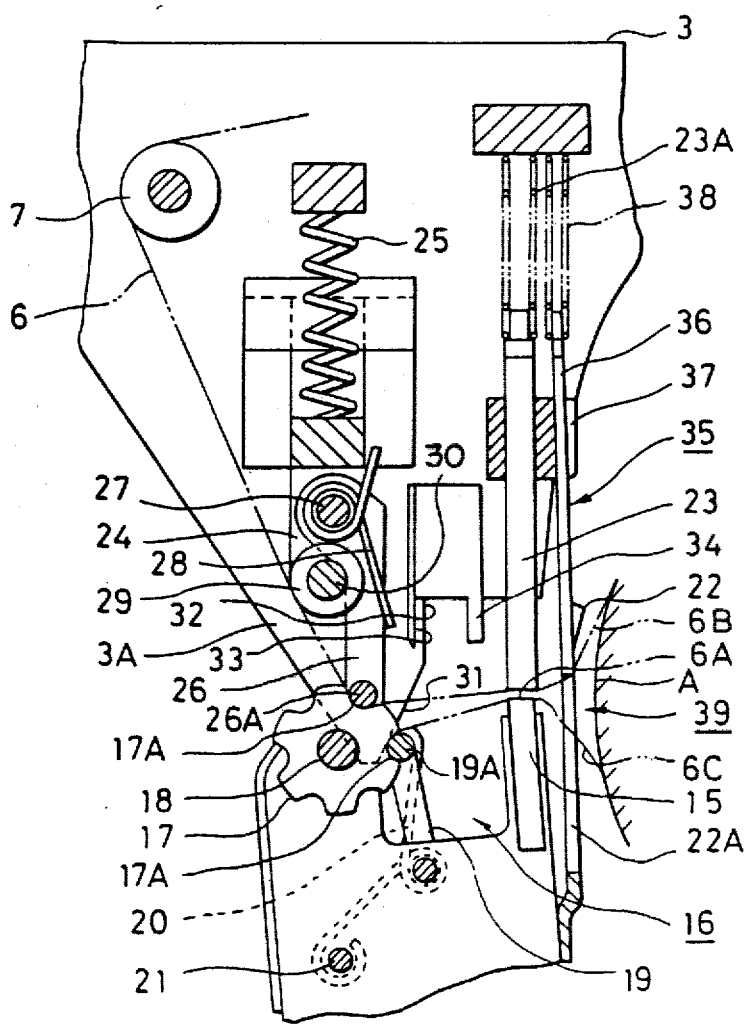

FIG. 3. B
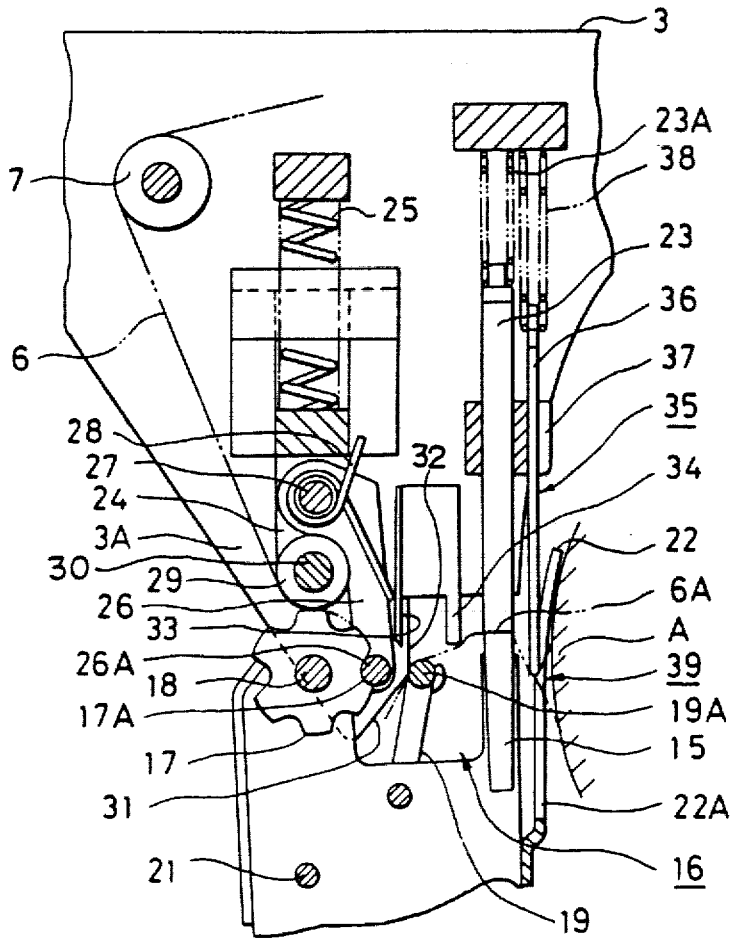

FIG. 3.C
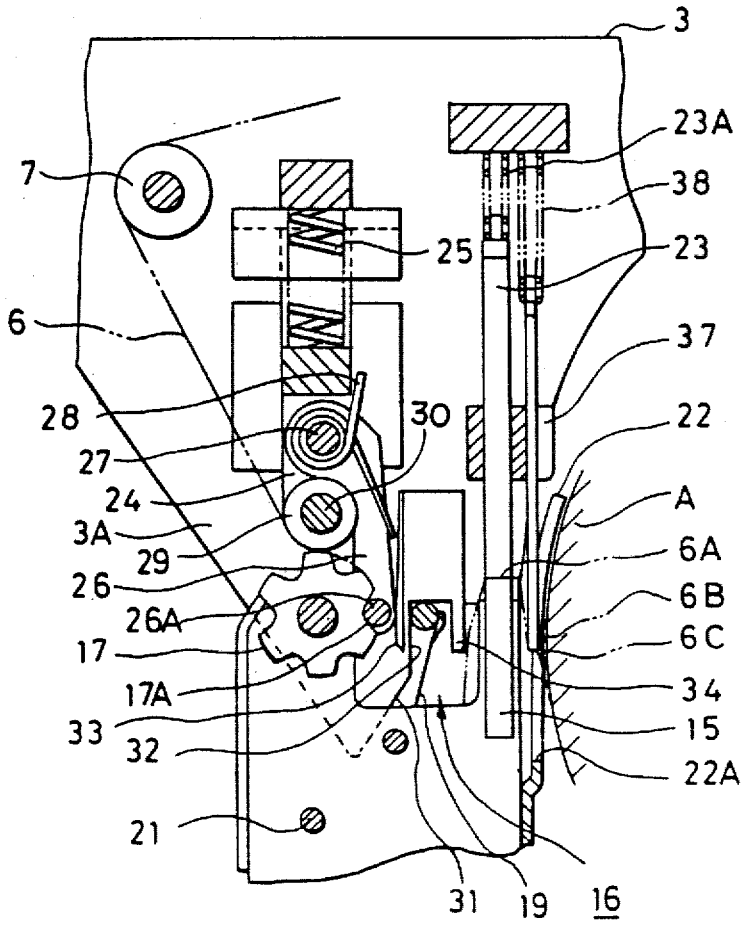

FIG.4
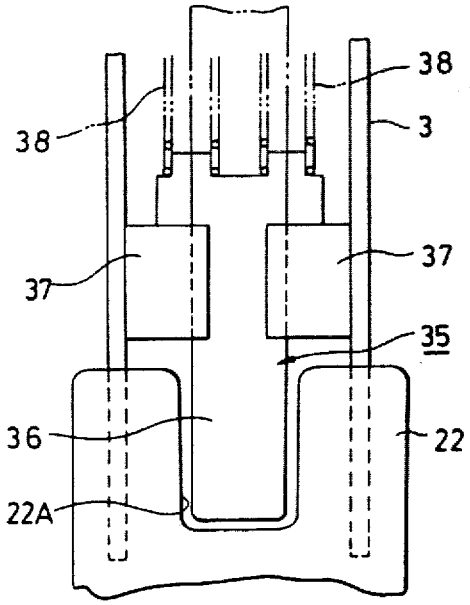
FIG.5
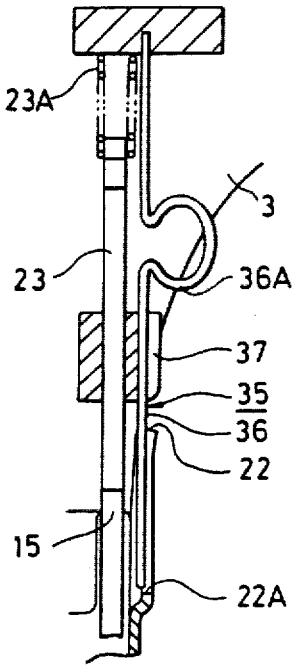
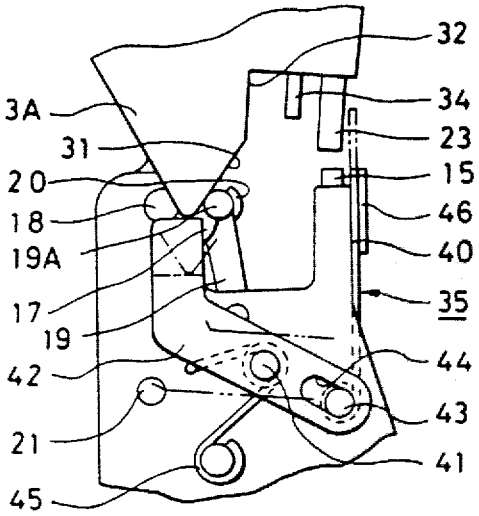
FIG.6

FIG.12
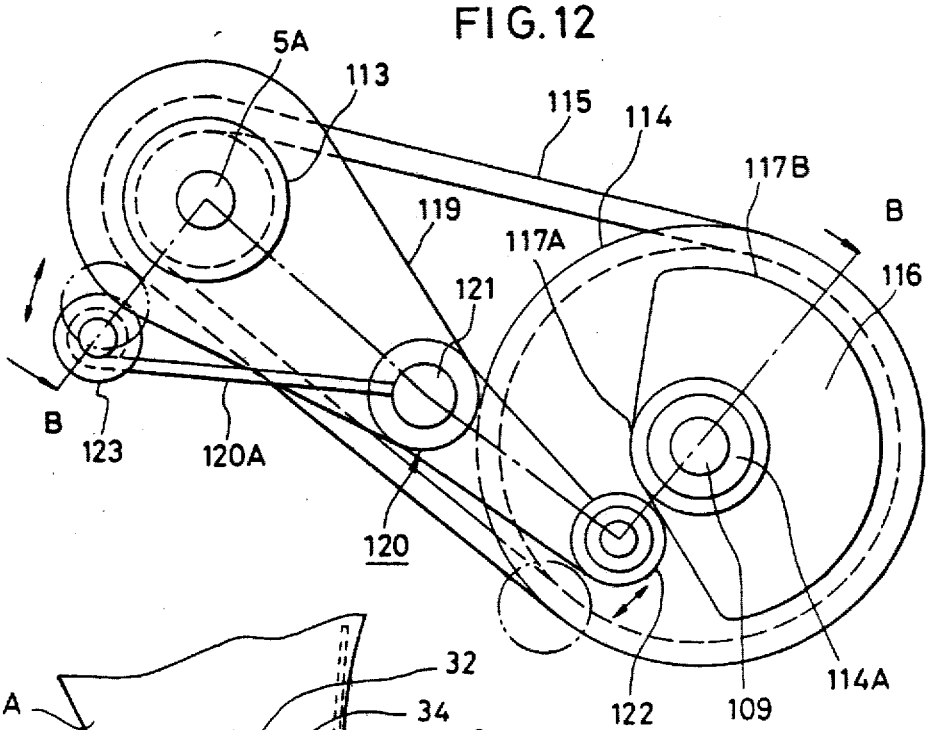
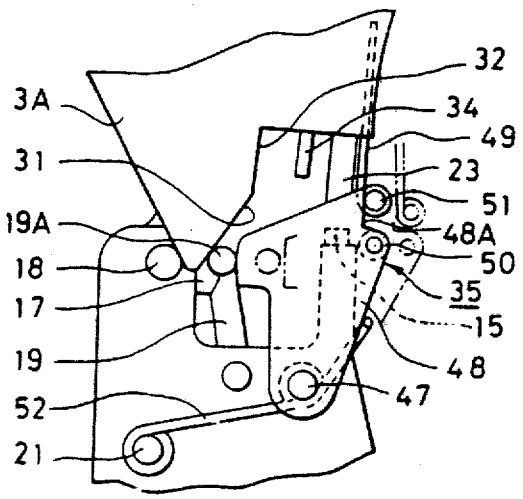
FIG.7

FIG.16
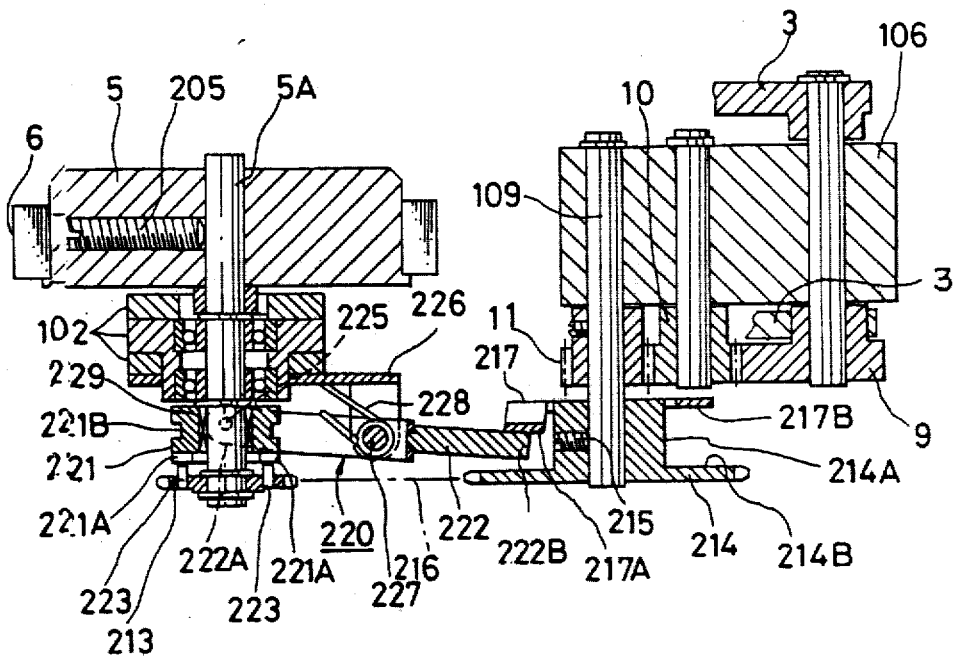
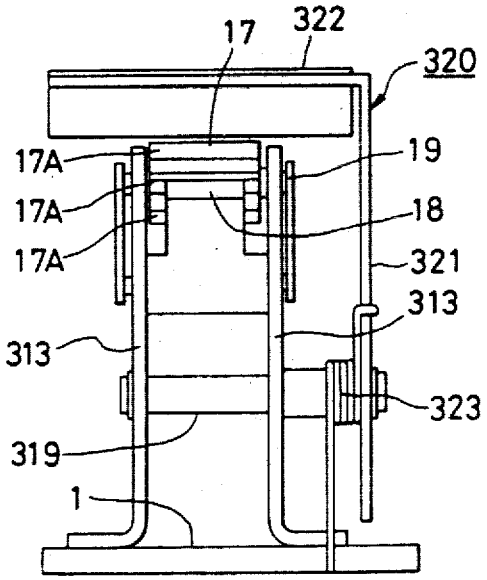
FIG.25

FIG.32.A
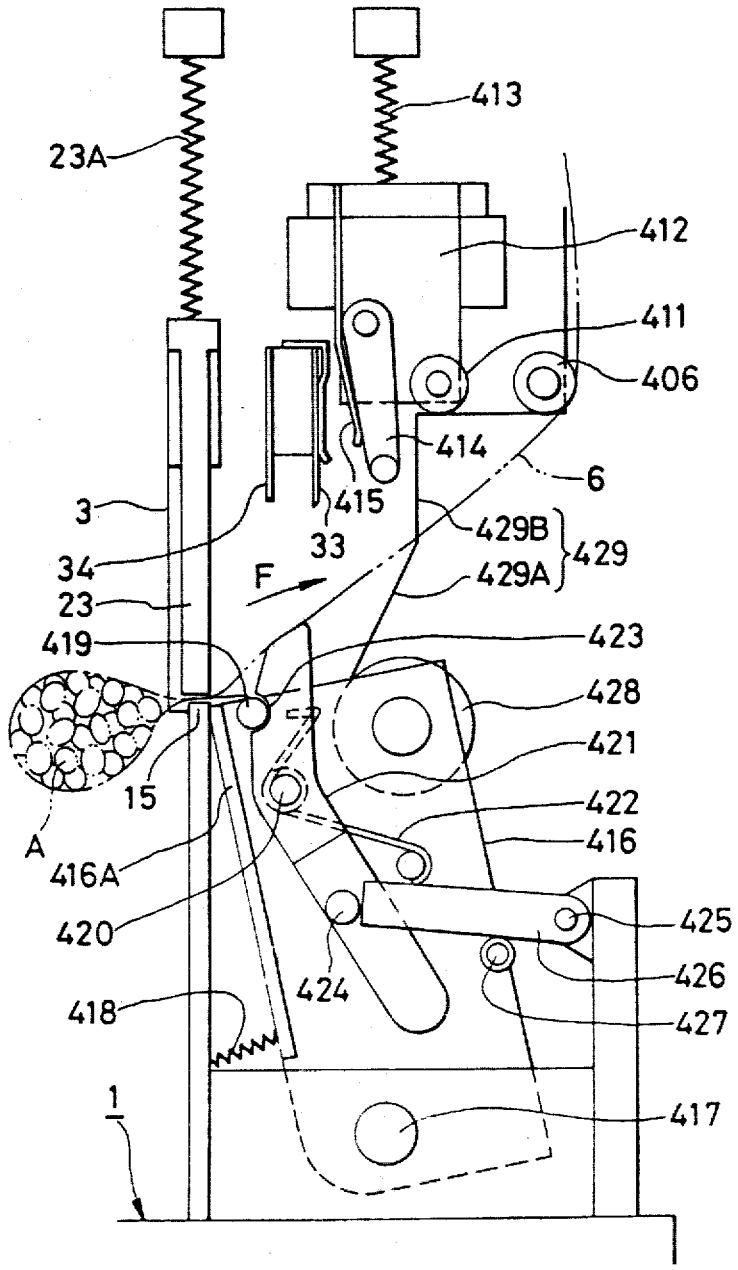

FIG. 32. B
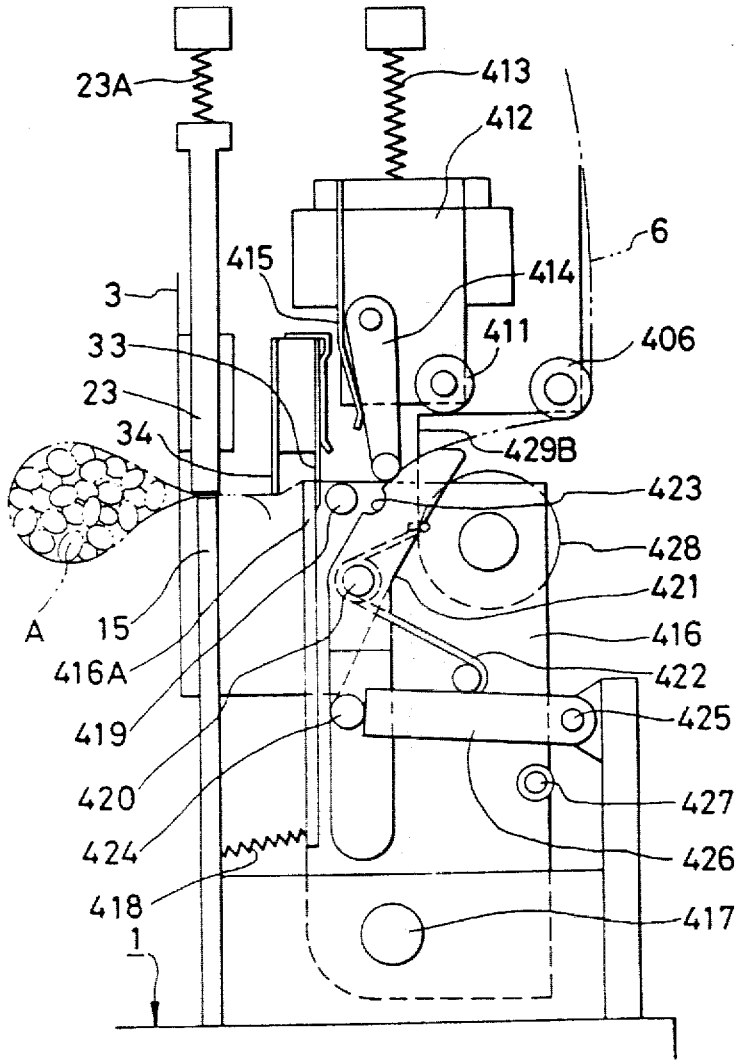

FIG.32.C
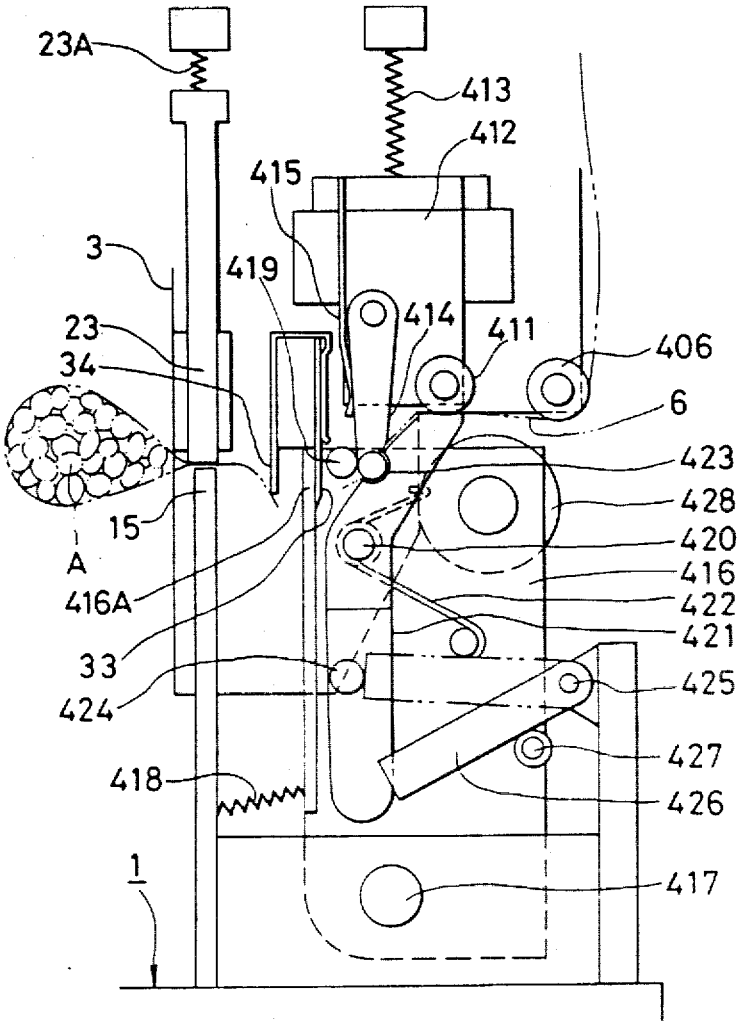

BINDING MACHINE

This is a continuation of application Ser. No. 056,074 filed July 9, 1979, now abandoned.

BACKGROUND OF THE INVENTION

The present invention relates to a binding machine and, more particularly, to a binding machine for tightly binding one or more articles to be bound by means of an adhesive tape such as a single-side adhesive tape, press-bonding type tape and the like. More particularly, the invention is concerned with a binding machine which increases the tightness of the binding by closing gap between the press-bonded portions of the wound tape and the article.

A typical conventional binding machine heretofore proposed has a bed carrying articles to be bound and a binding arm adapted to be swung toward and away from the bed to wind an adhesive tape around the articles on the bed. The ends of the tape wound around the articles are then press bonded to each other and cut to complete the binding of the articles.

In this type of binding machine, however, a small gap is formed between the press-bonded portions of the wound tape and the articles and as a result, the binding force is decreased, when the press-bonding of the tape ends is effected at a position spaced slightly away from the articles.

This problem is serious particularly in the binding of relatively rigid rod-shaped articles such as stems of tulip, stalks of green soybeans, pencils, sausages and the like. Namely, when the conventional binding machine is used for binding these relatively rigid articles, it is often experienced that the article drops off due to a loosening of the binding.

SUMMARY OF THE INVENTION

It is therefore an object of the invention to provide a binding machine capable of overcoming above-described problem of the prior art.

It is another object of the invention to provide a binding machine capable of decreasing the gap between the press-bonded portions of the wound tape and the articles so as to completely extinguish it between the tape and the articles by rewinding the excessive tape into the tape reel after winding the tape around the articles.

It is still another object of the invention to provide a binding machine in which the undesirable attaching of water droplets and part of the articles to be bound, e.g. chips of vegetable, to the adhesive surface of the tape is avoided to ensure an improved binding tightness.

The above and other objects, as well as advantageous features of the invention will become more clear from the following description of the preferred embodiments taken in conjunction with the accompanying drawings.

BRIEF DESCRIPTION OF THE PREFERRED EMBODIMENTS

FIGS. 3A, 3B and 3C are enlarged vertical sectional views of the apparatus shown in FIG. 2 in different states of operation.

FIG. 4 is a right side elevational view of the binding machine in the state shown in FIG. 3C;

FIG. 5 is a vertical sectional view of an essential part of a modification of the embodiment shown in FIGS. 1 to 4;

FIG. 6 is a front elevational view of an essential part of the binding machine which is another embodiment of the invention;

FIG. 7 is a front elevational view of an essential part of the binding machine which is still another embodiment of the invention;

FIG. 12 is a front elevational view of an essential part of a still further embodiment of the invention;

FIG. 16 is a sectional view taken along the line C—C of FIG. 15;

FIG. 25 is an enlarged side elevational view of a cover and its vicinity;

FIGS. 32A, 32B and 32C are front elevational views of a still further embodiment of the invention; showing particularly the portion around cramping means, in different states of operation.

DESCRIPTION OF THE PREFERRED EMBODIMENTS

Figures 1, 2:
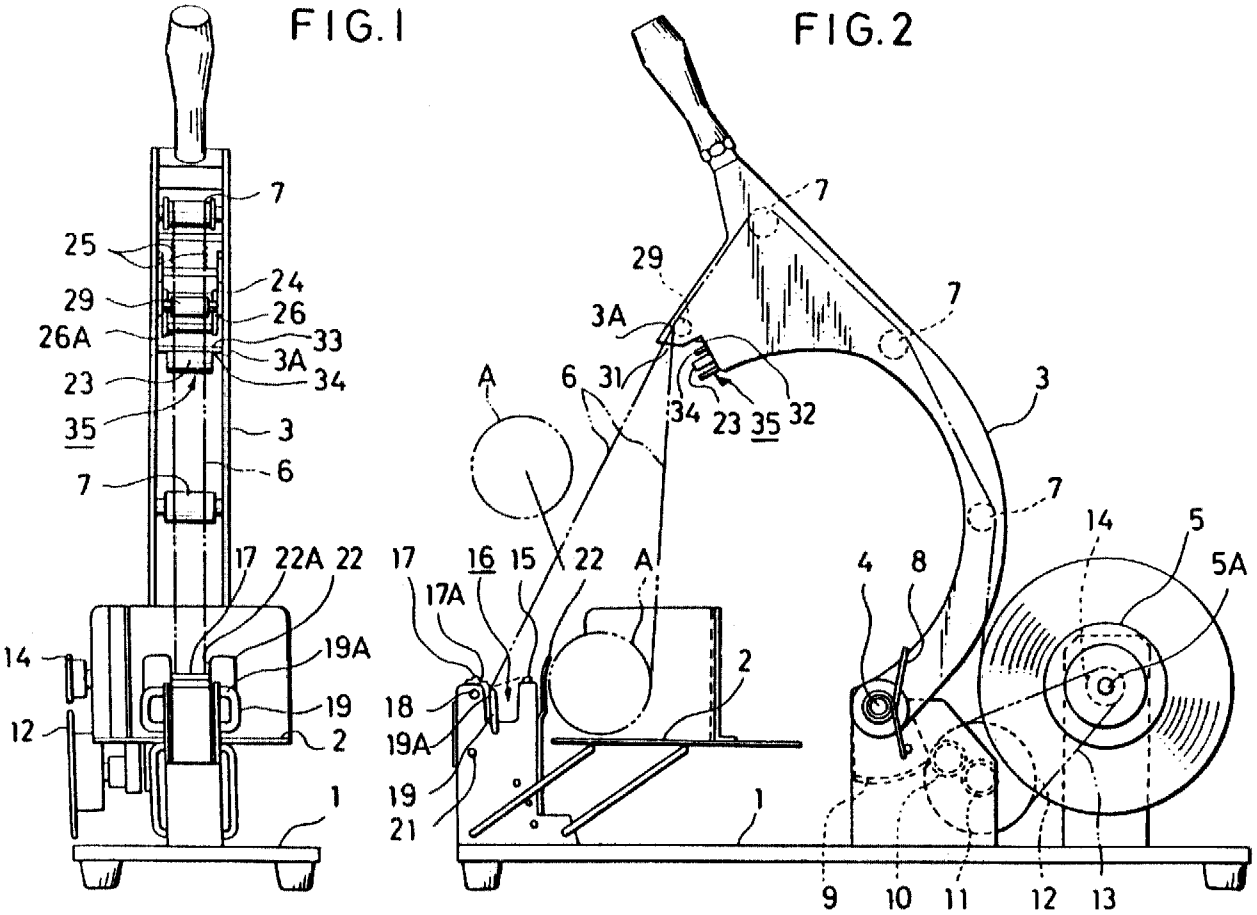
FIG. 1 is a side elevational view of a binding machine which is a first embodiment of the invention.
FIG. 2 is a front elevational view of the binding machine shown in FIG. 1.

Referring first to FIGS. 1 and 2, reference numeral 1 designates a base and a table 2 for receiving the articles to be bound is fitted at the center of the base 1 so as to enable the free adjustment of its height. The base 1 carries at its one end a tape reel 5 having an adhesive tape 6 which is in this case a single-side adhesive tape. Also, a binding arm 3 is pivoted at its base portion through a shaft 4 to the portion of the base 1 between the reel 5 and the table 2, for free swinging motion, i.e. rising and falling rotation, such that the tip portion 3A of the binding arm 3 moves toward and away from the other end of the base 1.

The binding arm 3 is provided with guiding means for guiding an adhesive tape extracted from the reel 5 toward the tip portion 3A with the adhesive surface of the tape directed outwardly. The guide means in this case consist of a plurality of rollers 7 which are disposed at a suitable interval along the length of the binding arm.

A reference numeral 8 is a spring which urges the tip portion 3A of the binding arm 3 in the direction where it is moved away from the base 1.

A sector gear 9 interlocking with the binding arm 3 is provided on the shaft 4. The arrangement is such that, as the binding arm 3 is swung down or rotated counter-clockwise in FIG. 2, the torque is transmitted from the sector gear 9 to the support shaft 5A of the tape reel 5 to cause a rewinding rotary motion of the tape reel 5, through gears 10,11, pulley 12, belt 13 and a pulley 14.

Referring now to FIG. 2 and FIG. 3A, a lower pressing body 15 is projectingly mounted on the other end of the base 1. A tape holder 17 is rotatably carried by a shaft 18 for one-direction rotation in the clockwise direction in the drawings, and is disposed at the outside of the lower pressing body 15 through a space 16 preserved therebetween.

In the outer peripheral surface of the tape holder 17, formed are a plurality of (6 in the described embodiment) equi-spaced axially extending grooves each having an arcuate cross-section. A tape cramping lever 19 having a tip portion 19A engageable with the grooves 17A is disposed within the space 16 for movement into and out of contact with the tape holder 17, and is urged by a spring 20 toward the tape holder 17. The tape cramping lever 19 and the tape holder 17 in combination constitutes cramping means. A reference numeral 21 denotes a pin which holds one end of the spring 20. The end of the adhesive tape 6 extracted from the tip portion 3A of the binding arm 3 is cramped between the grooves 17A of the tape holder 17 and the tip portion 19A of the tape cramping lever 19.

To the inner side of the lower pressing body 15, attached is an article suppressing plate 22 which is adapted to prevent the articles from projecting out. The article suppressing plate extends to both sides of the lower pressing body 15 and has a height larger than that of the latter.

As will be seen from FIG. 1 and also from FIG. 4, a notch 22A is formed in the central part of the suppressing plate 22 so as to extend downwardly to the level substantially equal to the level of the bottom of the lower pressing body 15. The notch 22A has a width somewhat greater than that of the tape 6. This article suppression plate 22 is adapted to prevent the articles to be bound from projecting into the space between the article and the press-bonded portions of the wound tape where the tape ends are to be press-bonded to each other.

Referring now to FIG. 3A, an upper pressing body 23 adapted to abut the lower pressing body 15 and constituting a pair of pressing bodies together with the latter is resiliently supported in the axial direction on the tip portion 3A of the binding arm 3 through the medium of a spring 23A.

A supporting member 24 is resiliently supported in the axial direction on the tip portion 3A at the outside of the upper pressing body 23 through a spring 25. A tape pushing means or a tape pushing lever 26 having one end 26A engageable with the groove 17A of the tape holder 17 is rotatably attached to the supporting member 24 through a shaft 27. The tape pushing lever 26 is clockwisely urged by a spring 28 as viewed in the drawings. A roller 29 adapted to strike the tape holder 17 is secured through a shaft 30 to the tip end of the supporting member 24. The shaft 30 is adapted to play also the role of preventing the displacement of the tape pushing lever 26 in the clockwise direction. An inclined cam surface 31 which can contact with the tape cramping lever 19 is formed on the tip portion 3A of the binding arm 3. A vertical cam surface 32 is formed continuously from the inner-side end of the inclined cam surface 32. These two cam surfaces in combination constitute a cramp controlling means.

The inclined cam surface 31 is adapted to pull away the tape cramping lever 19 from the groove 17A of the tape holder 17, while the vertical cam surface 32 is adapted to hold the tape cramping lever 19 at the position where the lever 19 is pulled away from the tape holder 17.

The tip end 3A of the binding arm 3 further carries a cutting edge 33 which can advance into the space between the tape holder 17 and the tip portion 19A of the tape cramping lever 19. Also, a tape releasing lever 34 which can move into the space between the tip portion 19A of the tape cramping lever 19 and the tape holder 17 is attached to the tip portion 3A of the binding arm 3.

In FIGS. 3A and 4, a reference numeral 35 denotes a tape adhesion device which is adapted to adhere, in connection with the movement of the tip portion 3A of the binding arm 3 toward and away from the base 1, parts 6B,6C of the tape 6 stretched between the portion to be press-bonded of the tape 6 and the articles A to be bound. In the described embodiment, the tape adhesion device 35 has an upper projecting member 36 which is supported on the tip portion 3A of the binding arm 3 through a guide member 37 and is urged by a spring 38 in the projecting direction so as to be capable of projecting downwardly toward a level below the upper end of the lower pressing body along the inner-side face of the lower pressing body 15 when the tape 6 is press-bonded by both pressing bodies 15,13.

The binding machine of this embodiment having the described construction operates in the manner described hereinunder.

The tape is extracted from the tip portion 3A of the binding arm 3 while the tip portion 3A of the binding arm 3 is spaced from the base 1 as shown in FIG. 2.

The end of the tape is cramped between the bottom of the groove 17A of the tape holder 17 and the tip portion 19A of the tape cramping lever 19. The articles A to be bound are pressed against the outer adhesive surface of the tape 6 so as to be placed on the table 2 through between the tip portion 3A and the base 1.

Subsequently, when the binding arm 3 is swung downward, i.e. counter-clockwise, the tape 6 is wound around the articles A, while the excessive tape is taken up by the tape reel 5.

Then, as the tip portion 3A of the binding arm 3 is lowered down to the position shown in FIG. 3A, the tip portion 26A of the tape pushing lever 26 comes into engagement with the groove 17A of the tape holder 17 and the tip portion 19A of the tape cramping lever 19 comes into contact with the inclined cam surface 31.

At the same time, the upper pressing body 23 abuts the lower pressing body 15 to press-bond the end portions of the tape 6 wound round the articles A. As a result of this press-bonding, a gap 39 is formed between two portions 6B,6C of the tape 6 stretched between the press-bonded portion 6A and the articles A to be bound.

Then, as the tip portion 3A of the binding arm 3 is lowered to the position shown in FIG. 3B, the tape cramping lever 19 is pressed by the inclined cam surface 31 and is moved away from the tape holder 17 to release the end of the tape 6. On the other hand, the tape pushing lever 26 is lowered keeping engagement with the groove 17A of the tape holder 17 so as to rotate the latter clockwise. Meanwhile, the upper projecting member 36 is moved downward along the side wall of the lower pressing body 15 so as to depress the upper tape portion 6B toward the lower tape portion 6C.

As the tip portion 3A of the binding arm 3 is lowered further to the position shown in FIG. 3C, the tape cramping lever 19 is held away from the tape holder 17 by means of the vertical cam surface 32, so as to allow the cutting edge 33 to come into the space therebetween to cut the tape 6 at the outside portion of the press-bonded portion 6A. Then, the tape releasing lever 34 comes into the gap between the tape cramping lever 19 and the lower pressing body 15 to extract the end of the press-bonded portion 6A of the tape 6 from the space between the tape holder 17 and the tape cramping lever 19. Therefore, it does never take place that the end of the press-bonded portion 6A of the tape 6 is erroneously cramped again between the tape holder 17 and the tape cramping lever 19 at the time of completion of the binding.

On the other hand, in the state as shown in FIG. 3C, the spring 23A is compressed to cause a strong pressing force of the pressing bodies 15,23 against each other. At the same time, the upper projecting member 36 is lowered further downward along the inner surface of the lower pressing body 15 so as to adhere the tape portions 6B and 6C to each other. Consequently, the gap 39 between the tape portions 6B,6C (See FIGS. 3A and 3B) are completely filled up and extinguished to avoid the loosening of the binding tape.

Needless to say, it is possible to adjust the projection amount of the upper projecting member 36 and the adhering force of the tape portions 6B,6C caused by the upper projecting member 36 by suitably selecting the length and the spring constant of the spring 38.

Then, as the binding arm end 3A is raised, the structural elements are reset from the state shown in FIG. 3C to the state shown in FIG. 3B. However, since the tape holder 17 is prevented from rotating counter-clockwise, the tape pushing lever 26 is reset to the upper position, leaving the new end of the tape 6 adhered to the groove 17A. Then, the tape cramping lever 19 is advanced into the groove 17A to hold the new end of the tape 6. The binding machine is reset to the position shown in FIG. 2 after the new tape end is held in the manner described.

Referring now to FIG. 5 showing a modification of the adhesive device 35, the upper projecting member 36 is made of a resilient material having a spring-like characteristic. An Ω-shaped bend 36A is formed at an intermediate portion of the upper projecting member 36 for providing the latter with a resiliency in the longitudinal direction.

According to this arrangement, the spring 38 in the described embodiment can be omitted, so that the number of parts is reduced.

FIG. 6 shows still another example of the tape adhesion device 35. In this tape adhesion device 35, there is provided a lower projecting member 40 which is disposed at one side of the lower pressing body 15 and adapted to be moved up and down from the side of the lower pressing body 15 along the side of the upper pressing body 23. Also, provided is a lever 42 supported at its intermediate portion by the base 1 through the shaft 41 and connected at one end thereof to the lower projection member 40. The arrangement is such that the lower projecting member 40 is moved in the projecting direction as the lever 42 is pressed at its other end by the binding arm 3. A pin 43 attached to the lower end of the lower projecting member 40 is engaged by an elongated bore 44 formed at the end of the lever 42. A reference numeral 45 denotes a spring for urging the lower projecting member 40 in the retracting direction. A reference numeral 46 denotes a guide member for guiding the lower projecting member while the latter moves up and down.

In the tape adhesion device 35 of this example, the lower projecting member 40 is moved to a level above the upper surface of the lower pressing body to move along the inner side surface of the upper pressing body 23, as the tape is press-bonded, so as to adhere two tape portions stretched between the press-bonded portion and the articles to fill up and extinguish the gap between the two portions of the tape wound around the articles, as in the case of the previously described example.

FIG. 7 shows a further example of the tape adhesion device 35. This device 35 includes a lower cramping body 48 disposed at one side of the lower pressing body 15 and adapted to be swung substantially horizontally around a shaft 47 toward the articles to be bound, when it is laterally pressed by the binding arm 3 through a tape cramping rod 19. The device further has an upper cramping body 49 disposed at one side of the upper pressing body 23 so as to be able to abut the lower cramping body 48. The upper cramping body 49 is adapted to be engaged with a step 48A formed on the lower cramping body 48 as the latter is moved toward the articles to be bound so as to be moved by, in this case, deflecting, toward the articles to be bound, together with the lower cramping body 48. These upper and lower cramping bodies 48 and 49 are provided with rollers 50,51 which are engageable with each other. A reference numeral 52 denotes a spring adapted for urging the lower cramping body 48 toward the lower pressing body 15.

When the pressing bodies 15,23 are abutted, the cramping bodies 48,49 of this example are abutted so as to adhere the tape portions of the tape between the press-bonded portion of the tape and the articles to be bound, and are then moved together toward the bound articles to fill up and extinguish the gap between the tape portions.

Although various examples of the tape adhesion device has been described, these examples are not inclusive and it is possible to adapt various other arrangements which can adhere the tape portions between the press-bonded portion and the articles in connection with the movement of the tip portion of the binding arm toward and away from the base.

In the described embodiment, a single-side adhesive tape having one side coated with an adhesive is used as the adhesive tape. It is possible, however, to use known self-adhesion type tape which produces the adhesive power by itself when subjected to an external pressure.

Figure 8:
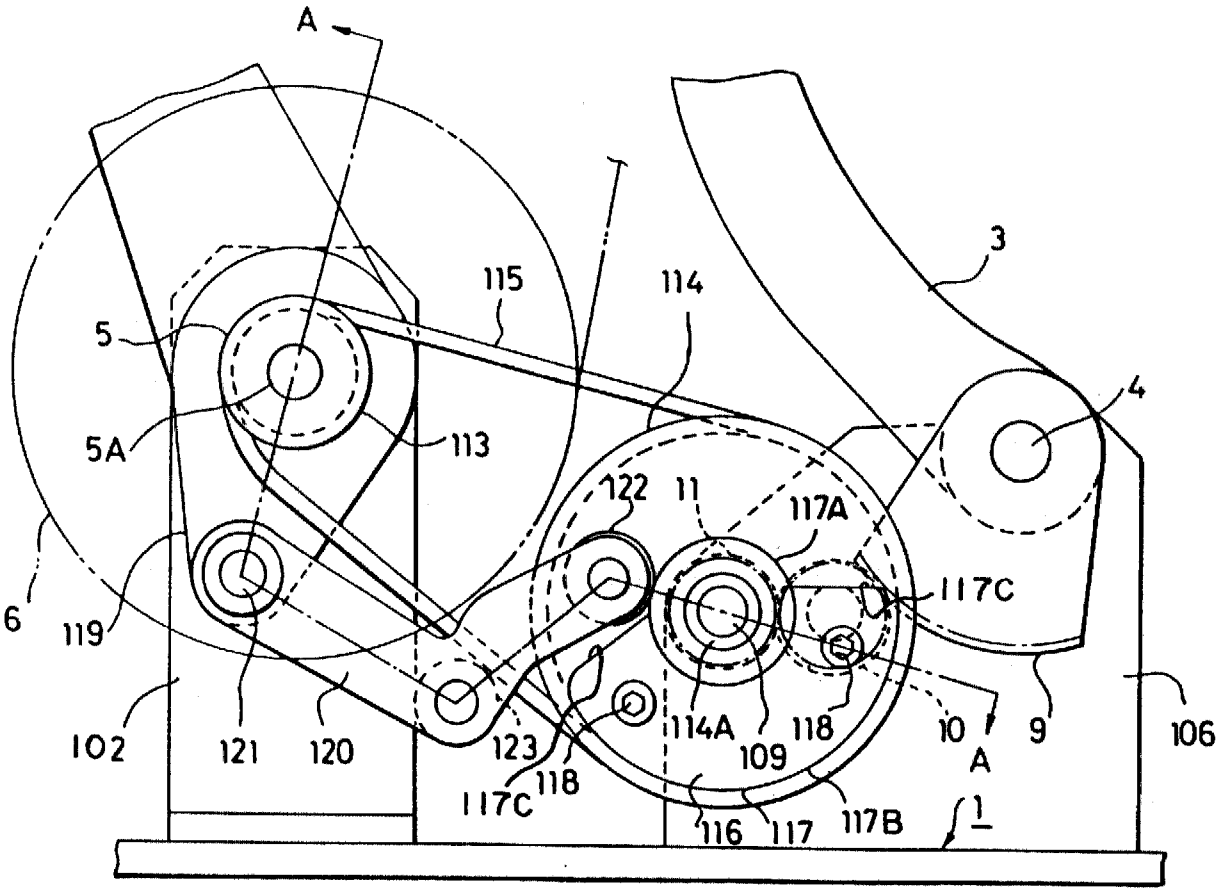
FIG. 8 is a front elevational view of an essential part of the binding machine which is a further embodiment of the invention.
Figures 9, 22:
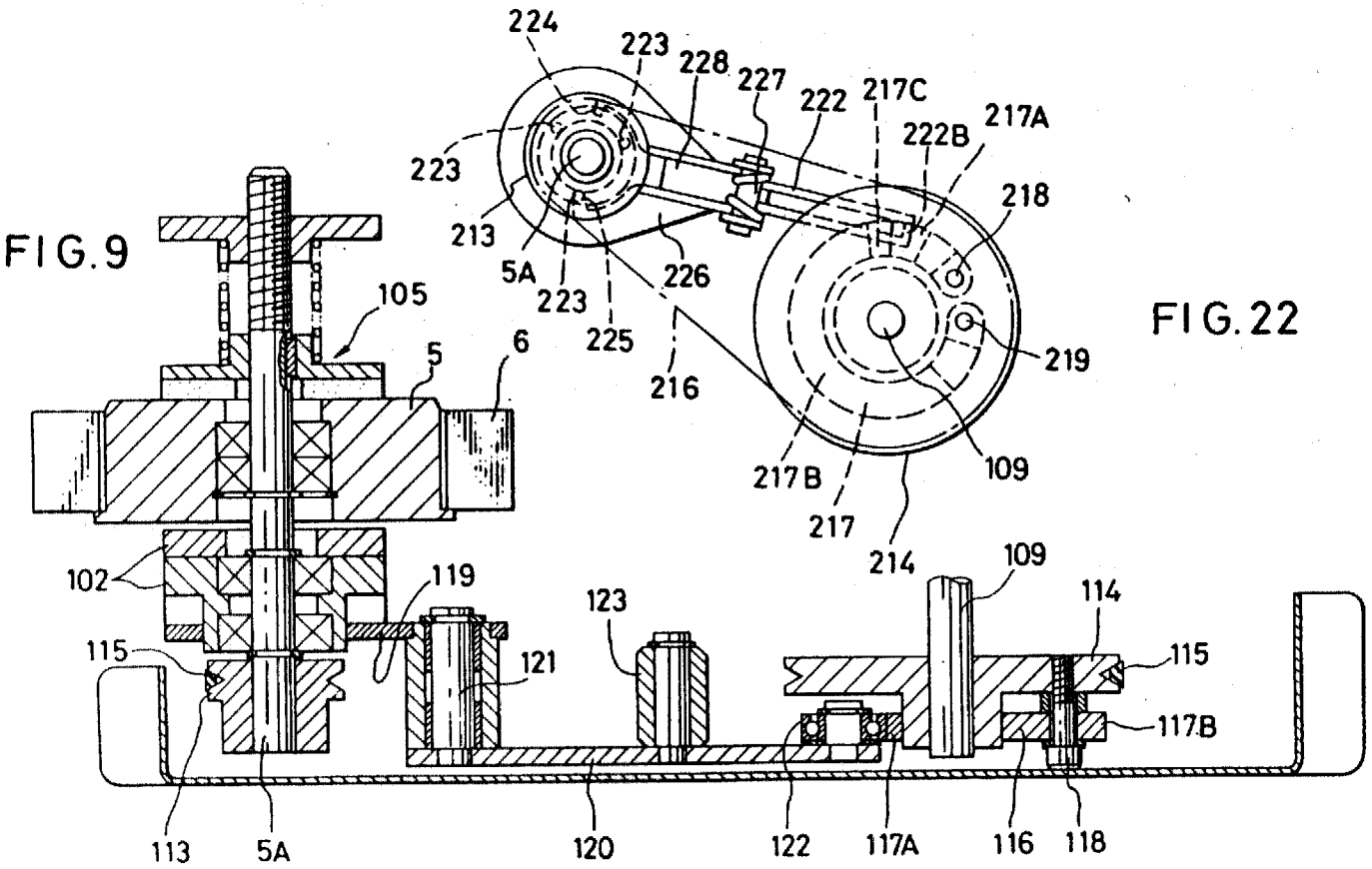
FIG. 9 is a sectional view taken along the line A—A of FIG. 8.
FIG. 22 is a front elevational view of the binding machine which is a still further embodiment of the invention.

FIGS. 8 and 9 show a modification of the tape rewinding means of the described embodiments. In these drawings, same reference numerals are used to denote the same parts or members as those in FIGS. 1 to 7. Similarly, the portions which are neglected from FIGS. 8 and 9 are constructed in the same way as those of the previously described embodiments.

This embodiment aims at tightly binding the articles to be bound by an adhesive tape 6 by smoothly retracting and rewinding the tape by the tape reel 5, when the binding arm 3 is swung down. Therefore, according to this embodiment, the gaps between two tape portions stretched between the articles and the pressing bodies is reduced to further fill up and extinguish the gap between the tape portions therebetween to ensure a stronger binding force.

In FIGS. 8 and 9, a support 102 is attached to one end of the base 1. The support shaft 5A of the tape reel 5 is rotatably supported by the support 102. The tape reel 5 is rotatably journaled on the support shaft 5A. The tape reel 5 carries a continuous binding adhesive tape 6 wound therearound. Ordinary single-side adhesive tapes and press-bonding type tapes can be used as the adhesive tape 6. The tape reel 5 and the support shaft 5A are operatively connected to each other through a friction clutch means 105. This friction clutch means 105 is adjustable to change the friction for torque transmission tape reel 5 and the shaft 5A.

A support 106 is attached to the intermediate portion of the base 1. The support 106 is rotatably journaled to a shaft 4 to which the base end of the binding arm 3 is fixed. The support member 106 also rotatably carries a rotary shaft 109. The shafts 4 and 109 are provided with a sector gear 9 and a gear 11, respectively. These gears 9,11 are connected each other through a medium of an intermediate gear 10 such that, when the binding arm 3 is swung down, the shaft 109 is rotated by an angle not greater than 360°.

Various other torque transmissions than the gears may be used for the torque transmission between the shafts 4 and 109.

A first and a second pulleys 113,114 are fixed to the support shaft 5A of the tape reel 5 and the rotary shaft 109, respectively, and are operatively connected to each other through a belt 115 which is loosely stretched therebetween. As the belt 115, flat, round and V-shaped belts can be used.

A rotary cam 116 having an outer peripheral cam contour 117 is attached to the boss 114A of the second pulley 114 coaxially with the latter, and is fixed to the same by means of bolts 118. The cam 116 may be formed integrally with the second pulley 114. It is also possible to support the cam 116 by a shaft independent of the shaft of the second pulley 114 and operatively connect the cam 116 and the pulley 114 by means of a torque transmission means.

The cam surface 117 of the cam 116 has an arcuate portion 117A of a comparatively small radius, another arcuate portion 117B of a comparatively large radius and intermediate portions 117C,117C interconnecting these arcuate portions 117A,117B.

A supporting arm 119 is fixed to the support 102. A belt pressing member 120 is pivoted at its one end to the tip portion of the supporting arm 119, by means of a pin 121. To the other end of the belt pressing member 120, attached rotatably is a cam roller 122, while a belt pressing roller 123 is rotatably provided on an intermediate portion of the belt pressing member 120. The members and parts 120, 122 and 123 in combination constitute an interruption control means.

The above-stated construction operates in the manner described hereinunder. When the binding arm 3 is in the elevated state as shown in FIG. 8, the cam roller 122 is kept in contact with the arcuate portion 117A of smaller diameter. In this state, the belt pressing roller 123 is in a position that it does not apply tightening force to the belt 115. Therefore, in this state, the belt 115 is loosened and the interconnection is cut off between the support shaft 5A and the rotary shaft 109.

As in the case of the embodiment described before, the articles to be bound are inserted between the tip portion of the binding arm 3 and the cramp means of the base 1 by pressing the tape 6. When the tape 6 is pressed by the articles to be bound, tensile force is applied to the tape 6. In this state, the tape reel 5 is allowed to rotate together with the support shaft 5A, so that the tape reel 5 is rotated due to the tensile force applied to the tape 6 by the articles, so as to pull out the tape 6 in accordance with the tensile force. Therefore, it does never take place that the tape 6 is escaped from the tape holding section by the tensile force of the tape 6.

Figure 10:
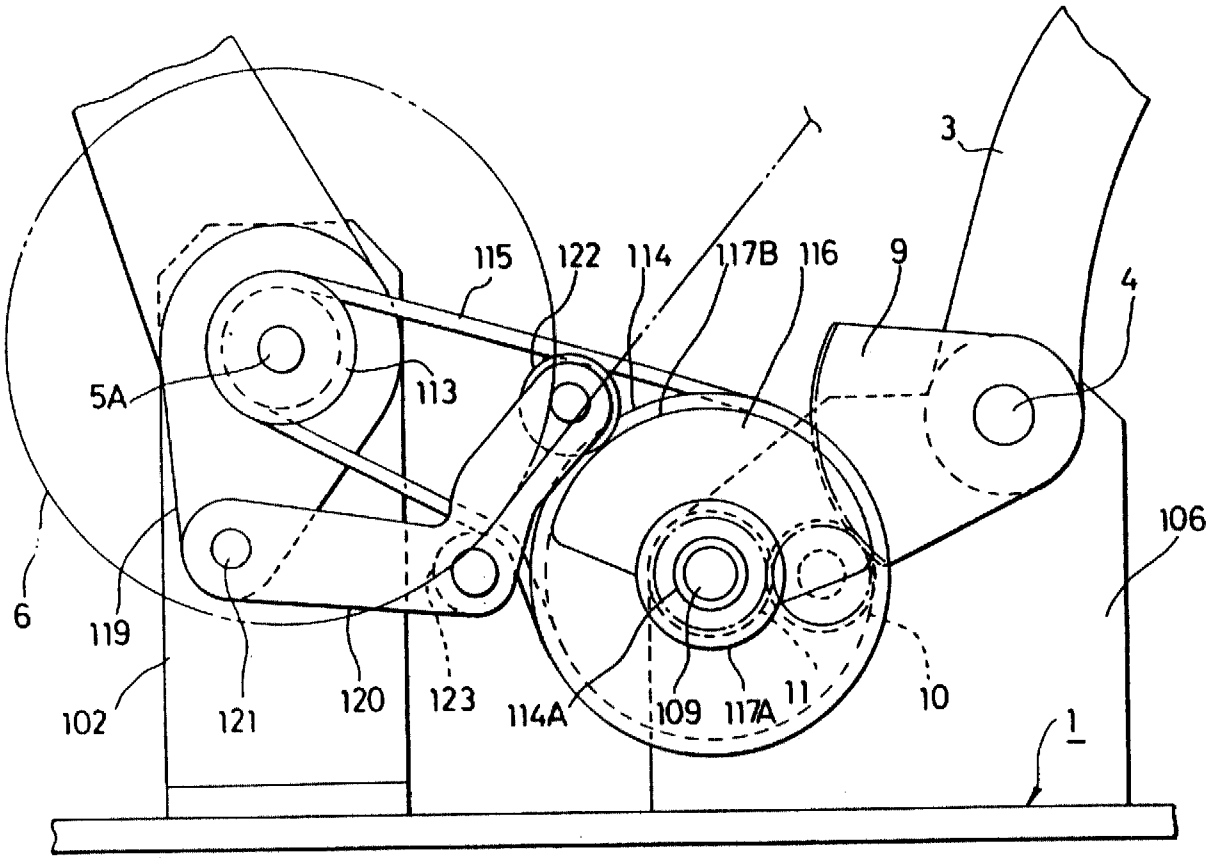
FIG. 10 is a front elevational view of the binding machine shown in FIG. 8 in the state of operation.

After placing the articles on the table, the cam 116 starts to rotate together with the rotary shaft 109 in the clockwise direction as viewed in FIG. 8, as the downward swinging of the binding arm 3 is commenced, so that the cam roller 122 is quickly lifted and rotated counter-clockwise by the intermediate portion 117C of the cam 116, centering around the pin 121. Simultaneously, the belt pressing roller 123 is also displaced upward to press the belt 115 in the manner shown in FIG. 10 to tighten the belt 115. Therefore, the torque of the rotary shaft 109 is transmitted to the support shaft 5A through the belt 115, so that the tape reel 5 is rotated counter-clockwise as viewed on FIG. 10 to retract and rewind the tape 6. It is possible to adjust the tightness of the tape 6 by adjusting the frictional connecting force of the frictional clutch means 105 between the reel 5 and the support shaft 5A. More specifically, the tightness of the tape 6 is reduced as the frictional force is reduced, whereas the tightness of the tape 6 is increased to reduce the aforementioned gap between two tape portions, as the frictional force in the clutch means is increased.

The circumferential length of the arcuate portion 117B of larger diameter of the cam 116 is so selected that the cam roller 122 does not come out of the portion 117B when the binding arm 3 is fallen down onto the base 1.

In the described embodiment, since the belt pressing roller 123 presses the belt 115 from the outside of the latter, the circumferential lengths of portions of the pulleys 113,114 contacted by the belt 115 are increased to diminish the tendency of undesirable slip of the belt 115 on these pulleys 113,114.

Figure 11:
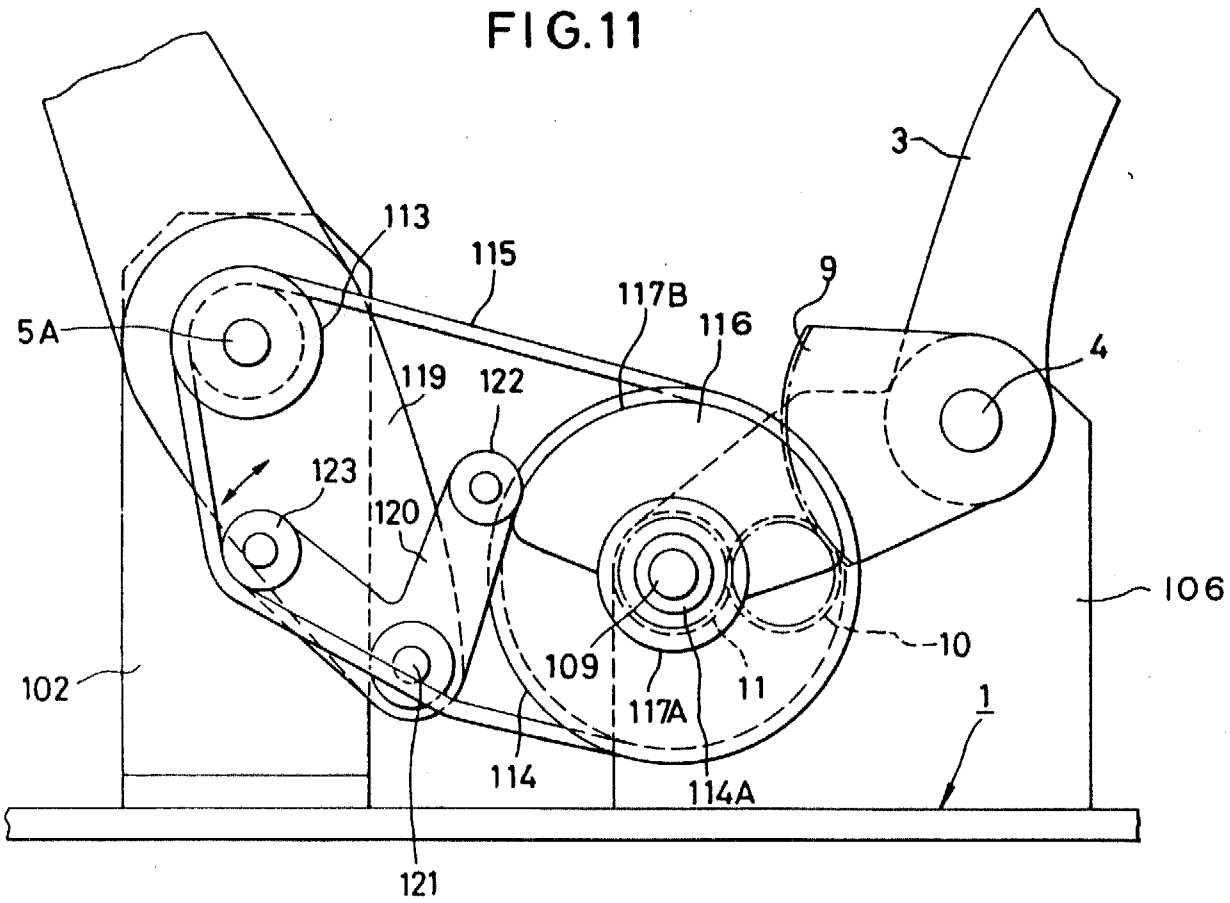
FIG. 11 is a front elevational view of an essential part of the binding apparatus which is a still further embodiment of the invention.

FIG. 11 shows an alternative arrangement in which the belt-pressing member 120 is rotatably secured at its intermediate portion to the support arm 119 through a pin 121, and a cam roller 122 and a belt pressing roller 123 are rotatably secured to the ends of the belt pressing member 120 respectively, while the belt pressing roller 123 is disposed at the inside of the belt 115. In this case, when the cam roller 123 is positioned on the arcuate portion 117B of larger diameter of the cam 116, the belt 115 is tightened by the belt pressing roller 123 which presses the belt 115 from the inner side of the latter.

Figures 13, 23:
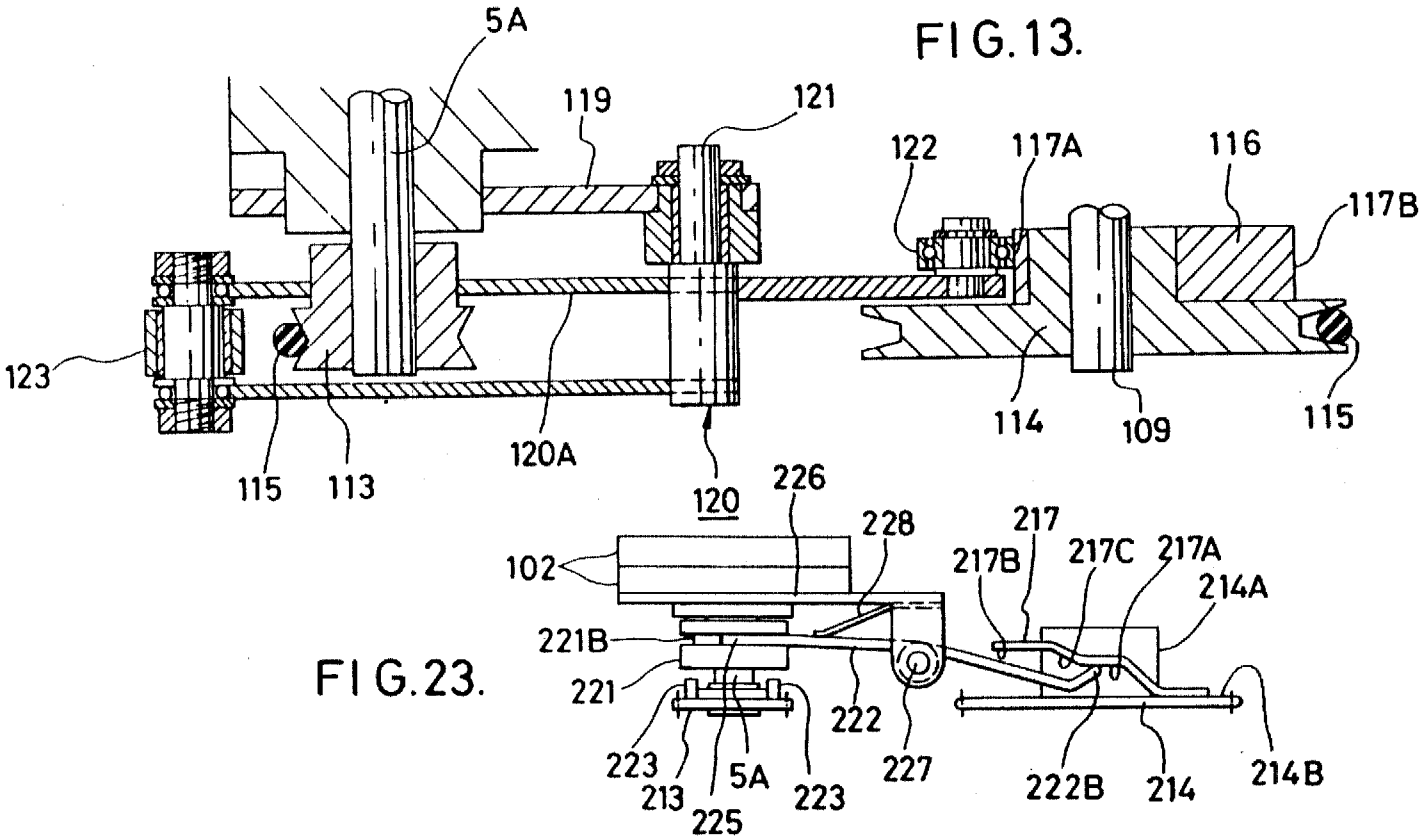
FIG. 13 is an exploded sectional view taken along the line B—B of FIG. 12.
FIG. 23 is a plan view of the binding machine as shown in FIG. 22.

FIGS. 12 and 13 show another modification of the belt pressing member 120, in which the same reference numerals are used to denote the same parts and members as those of FIGS. 8 and 9. In this example, the belt pressing member 120 is rotatably secured at its intermediate portion to the support arm by means of a pin 121. The portion 120A of the belt pressing member 120 through which the pin-pivot portion is connected to the belt pressing roller 123 is made of a spring material. In addition, the belt pressing roller 123 is so arranged that it presses the belt 115 on the peripheral surface of the first pulley 113. In this case, it is possible to obtain a constant belt-pressing force thanks to the use of the spring member 120A. In addition, the impact delivered to the tape reel 5 at the time of commencement of the rewinding is conveniently absorbed by the spring member 120A so as to ensure a smooth binding operation.

Figure 14:
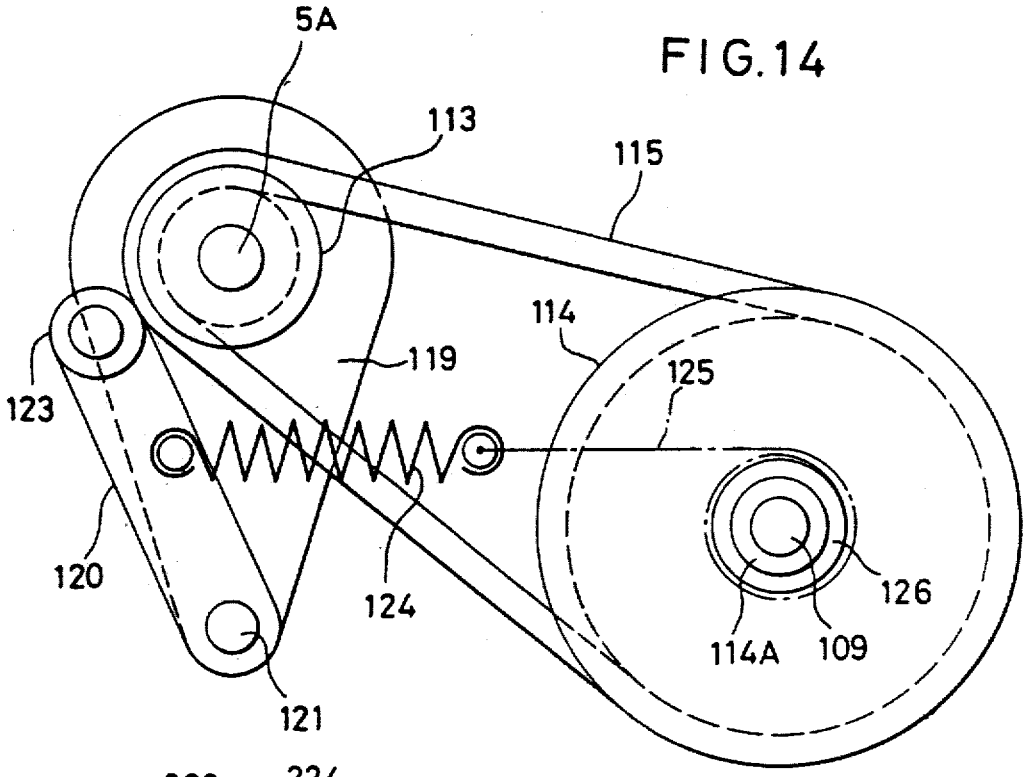
FIG. 14 is a front elevational view of a binding machine which is a still further embodiment of the invention.

FIG. 14 shows still another example of the tape rewinding means. In this drawing, same reference numerals are used to denote the same members and parts as those in FIG. 8. In this example, the belt-pressing member 120 is attached rotatably at its one end to the tip portion of the supporting arm 119 by means of a pin 121. In addition, a belt-pressing roller 123 is attached to the other end of the belt-pressing member 120. The belt-pressing roller 123 is positioned such that it presses the belt 115 on the peripheral surface of the first pulley 113. A coiled spring 124 is attached at its one end to the intermediate portion of the belt-pressing member 120, while the other end of the coiled spring 124 is connected to one end of a wire 125. The other end of the wire 125 is connected to and wound around a reel 126 as a cam attached to the boss 114A of the second pulley 114.

In this case, as the binding arm 3 is swung down, the reel 126 is rotated clockwise as viewed in the drawing, together with the second pulley shaft 109. Then, the wire 125 is taken up by the reel 126 to stretch the coiled spring 124, so that the belt-pressing member 120 is pulled by the coiled spring 124 so as to be rotated clockwise as viewed in the drawing. In consequence, the belt pressing roller 123 presses the belt 115 on the peripheral surface of the first pulley 113. In this case, the impact generated at the time of start of the rewinding is relaxed by the coiled spring before it is delivered to the tape reel 105, thereby to ensure a smooth binding operation.

The second pulley and the cam may be provided on the pivot shaft (support shaft 4) of the binding arm. By so doing, the sector gear 9, intermediate gear 10 and the gear 11 are eliminated to simplify the construction of the whole machine.

Figure 15:
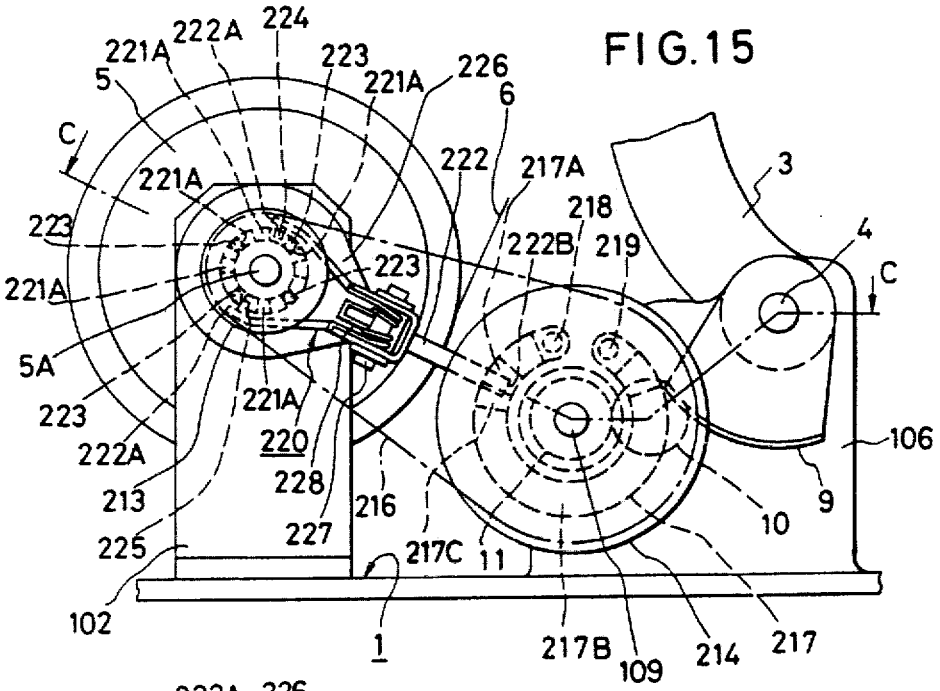
FIG. 15 is a front elevational view of a binding machine which is a still further embodiment of the invention.

FIGS. 15 and 16 show still another example of the tape rewinding means. In this example, a second sprocket 213 as a second rotary body is attached rotatably to the support shaft 5A, while a first sprocket 214 as a first rotary body is fixed to the rotary shaft 109 by means of a screw 215. The second sprocket 213 and the first sprocket 214 are operatively connected to each other by means of a chain 216. The first and the second rotary bodies may be constituted by other members such as pulleys or gears except the sprocket.

An arcuate disc cam 217 is provided along the boss 214A of the first sprocket 214. This disc-shaped cam 217 is fixed to the end surface 214B of the first sprocket 214 at its both end portions by means of pins 218,219.

Figure 17:
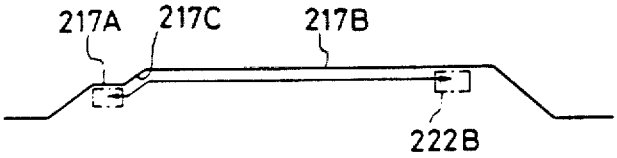
FIG. 17 is a cam-operation diagram showing the axial position (cam contour) of a disc-shaped cam shown in FIG. 15 in relation to the rotation angle of the cam.

FIG. 17 shows the contour of the cam 217 adapted to cause, when rotated, a desired operation of the later-mentioned lever (follower). As will be seen from FIG. 17, the disc cam 217 is provided with a first cam surface 217A, a second cam surface 217B which is spaced in the axial direction from the first cam surface 217A, and an inclined cam surface 217C through which the first and the second cam surfaces 217A, 217B are connected to each other.

A reference numeral 220 denotes an interruption control means which is operatively connected to the disc cam 217 to couple, when the binding arm 3 is swung down, the support shaft 5A and the second sprocket 213 to each other so that they may not be rotated relatively to each other, thereby to drive the tape reel 5 for the rewinding action. The interruption control means 220 in this case has a slide body 221 attached to a support shaft 5A for free axial movement, and a lever 222 having one end engaging the slide body 221 and the other end 222B engaging the disc cam 217. At one end of the slide body 221, projection receiving recesses 221A are formed at suitable circumferential interval. These projection receiving recesses 221A are adapted to receive the projection 223 which are attached to the second sprocket 213. Also, on the outer peripheral surface of the slide body 221, formed is an annular groove 221B. The lever 222 has a forked end 222A the branches of which extend along both sides of the slide body 221, and the projections 224,225 formed on the branches are received by the annular groove 221B.

The lever 22 is supported through the shaft 227 by a support arm 226 which in turn is fixed to the support body 102. A spring 228 urges the lever 222 counterclockwise as viewed in FIG. 16.

In this example, a one-direction clutch means 229 are disposed between the support shaft 5A and the slide body 221. More specifically, the slide body 221 is attached to the support shaft 5A for free axial movement, through the onedirection clutch 229.

In operation, when the binding arm 3 is in the elevated state as shown in FIG. 15, the end 222B of the lever 222 is placed in contact with the first cam surface 217A of the disc cam 217. In this state, the slide body 221 is positioned away from the second sprocket 213 by means of the lever 222, and the projections 223 are kept out of engagement with the projection receiving recesses 221A. In this state, therefore, the second sprocket 213 and the support shaft 5A are allowed to rotate relatively to each other. In this state, as mentioned before, the articles to be bound are inserted between the tip portion of the binding arm 3 and the cramp means of the base 1 depressing the adhesive tape 6 inwardly. As the tape 6 is pressed by the articles, the tape reel 5 is rotated because the latter is rotatable together with the support shaft 5A, so as to pull out the tape 6. Therefore, the trouble of escaping of the tape 6 from the cramping means is fairly avoided.

As the binding arm is swung down after the mounting of the articles on the table, the disc cam 217 starts to rotate in the clockwise direction as viewed in FIG. 15 together with the first sprocket 214. Since the lever 222 is urged counterclockwise by the spring 228 as viewed in FIG. 16, the end 222B of the lever 222 is moved relatively from the first cam surface 217A to the second cam surface 217B via the inclined cam surface 217C, which in turn causes a counter-clockwise rotation of the lever 222 centering around the fulcrum constituted by the shaft 227. As a result, the slide body 221 is moved by the lever 222 toward the second sprocket 213, so that the projections 223 of the second sprocket 213 and the projection receiving recesses 221A of the slide body 221 are brought into engagement with each other. Consequently, the second sprocket 213 and the slide body 211 are coupled to each other so that they may not be rotated relatively to each other. In addition, since the one-direction clutch means 229 acts to fix the slide body 221 and the support shaft 5A to each other when the slide body 221 rotates clockwise as viewed in FIG. 15, the support shaft 5A and the tape reel 5 are rotated clockwise together with the second sprocket 213 as viewed in FIG. 15 so as to retract and rewind the excessive length of the tape 6.

Figure 18:
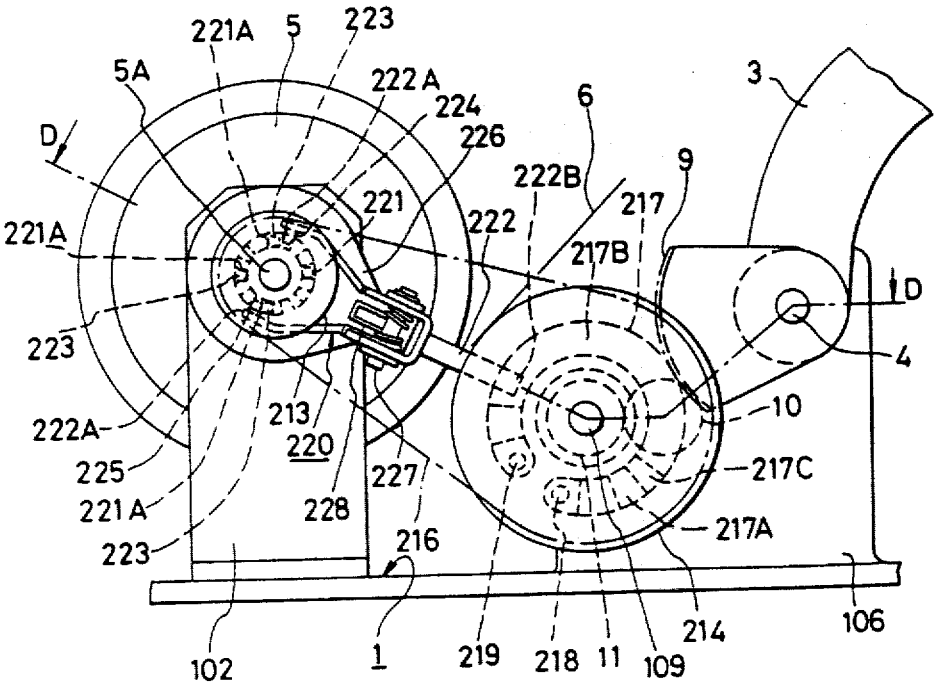
FIG. 18 is a front elevational view of an essential part of the binding machine shown in FIG. 15 in the state of operation.
Figure 19:
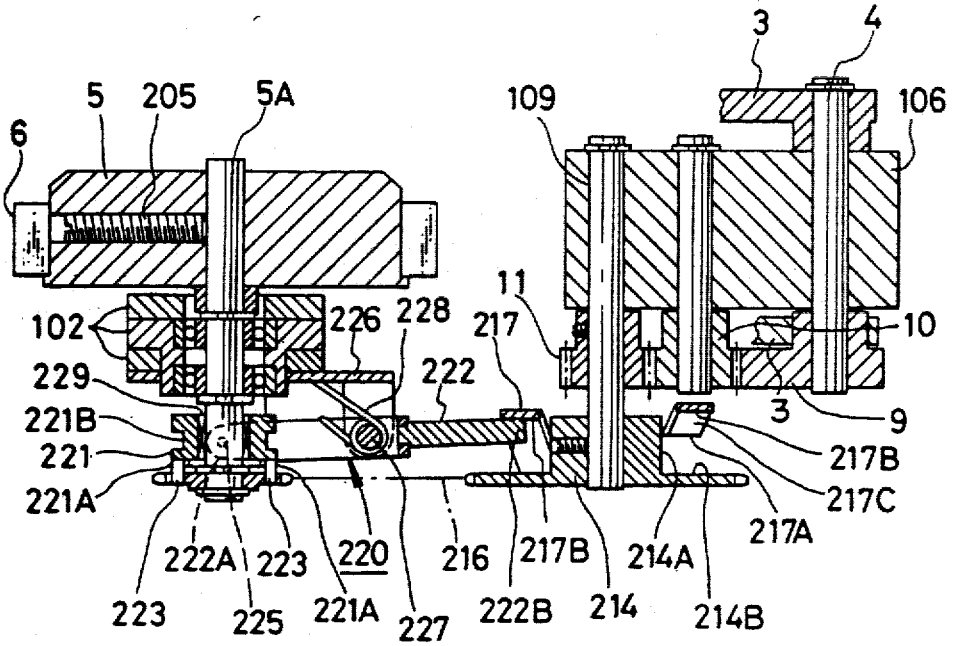
FIG. 19 is a sectional view taken along the line D—D of FIG. 18.

If a frictional clutch means are interposed between the support shaft 5A and the tape reel 5 instead of the screw 205, the fastening force of the tape 6 is reduced as the frictional engaging force in the clutch means is reduced. To the contrary, as the frictional engaging force in the clutch means is increased, the tightening force on the tape 6 is increased to ensure an increased tightening force of the tape 6. FIGS. 18 and 19 shows the binding arm 3 in the state in which it has been swung down onto the tape 6 to press-bond the tape end portions of the tape 6 wound round the articles by means of a pair of pressing bodies.

Then, as the binding arm 3 is rotated upward so as to be in the initial state, the disc cam 217 is rotated from the state shown in FIG. 18 in the counter-clockwise direction together with the first sprocket 214, so that the second sprocket 213 and the slide body 221 are rotated counter-clockwise. In this state, since the one-direction clutch means 229 act to disconnect the slide body 221 and the support shaft 5A from each other, the support shaft 5A and the tape reel 5 are not rotated. The tape 6 is therefore not pulled out in this state. In consequence, the end 222B of the lever 222 slides along the cam surface of the disc arm 217, from the second cam surface 217B to the first cam surface 217A. As a result, the slide body 221 is disengaged from the second sprocket 213 to the starting position.

Further modifications of the tape rewinding means as summarized below are possible.

Figure 20:
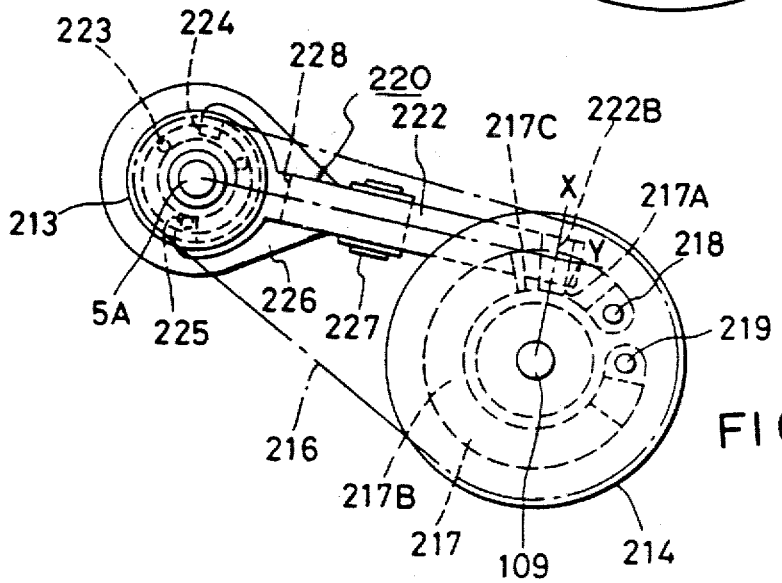
FIG. 20 is a front elevational view of an essential part of a binding machine which is a still further embodiment of the invention.
Figure 21:
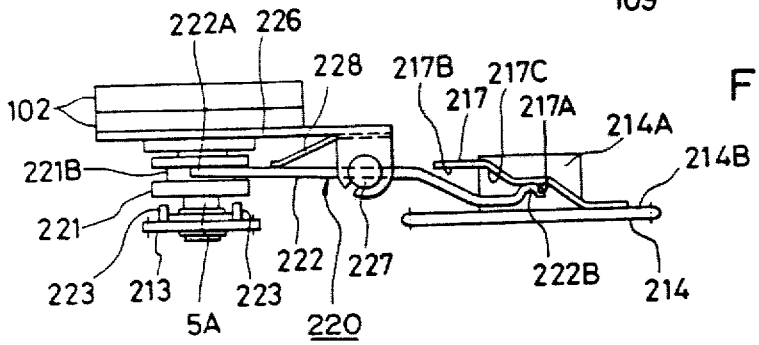
FIG. 21 is a plan view of the binding machine as shown in FIG. 20.

1. As shown in FIGS. 20 and 21, the longitudinal axis Y of the lever 222 is disposed at a right angle to the line X which passes the center of the rotary shaft 109 and the point at which the lever 222 contacts the disc cam 217. In this case, since no force is exerted on the lever 222 in the direction perpendicular to the longitudinal axis of the latter, the movement of the lever 222 is highly smoothed. Also, the sliding between the lever 222 and the disc cam 217 is smoothed as the point of contact of the other end 222B of lever 222 is shaped into a circular form.

2. As shown in FIGS. 22 and 23, the lever 222 may be constituted by a single wire. In this case, the starting end of the wire 222 is bent to form a projection 224, and, after making a turn around the shaft 227, the wire 222 is extended to the disc cam 217 so as to form a contacting portion 222B. The contacting portion 222B is bent in the U-like form and wound again around the shaft 227. Finally, the terminal end of the wire 222 is bent to form a projection to constitute the lever.

In this case, the construction of the lever is simplified and the number of parts is reduced.

3. The disc cam 217 may be integrally secured to the boss of the first sprocket 214 or may be attached directly to the rotary shaft 109. Alternatively, a cam groove having a cam characteristic as shown in FIG. 17, formed in the outer peripheral surface of boss 214 of the first sprocket 214 may be used in place of the disc cam. In this case, the lever end is received and engaged by this cam groove.

4. The one-direction clutch means may be provided between the tape reel and the support shaft, or may be omitted.

5. The second rotary body may be attached directly to the support shaft 4.

Figure 24:
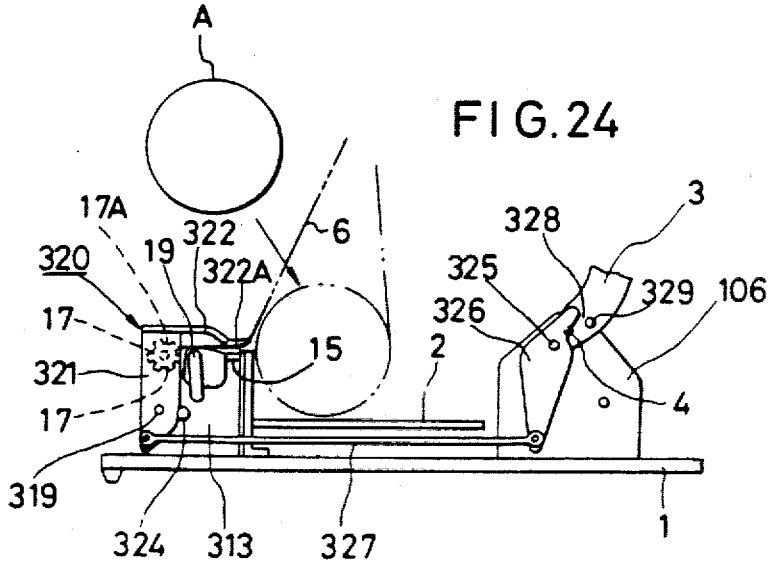
FIG. 24 is a front elevational view of a binding machine which is a still further embodiment of the invention.
Figure 26:
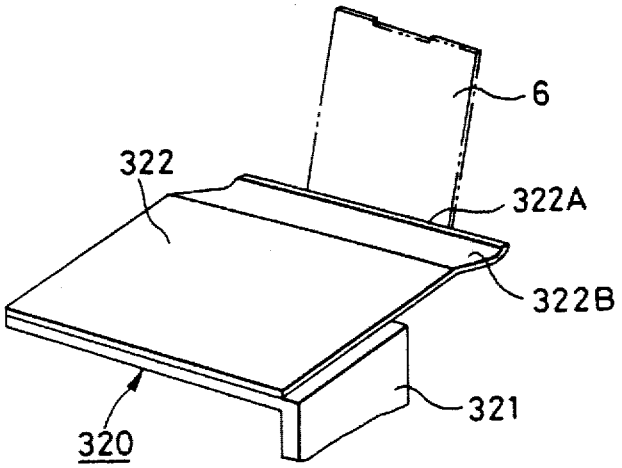
FIG. 26 is a perspective view of a part of the cover.

FIGS. 24 to 26 show another embodiment of the invention in which same reference numerals are used to denote the same members and parts as those of the first embodiment shown in FIGS. 1 to 7. The portions which are not shown are identical to those of FIGS. 1 to 7.

In this embodiment, a protective cover is provided in the vicinity of the pressing body on the base, i.e. in the vicinity of the lower pressing body. This protective cover is moved in connection with the binding arm in such a way that it leaves the position above the lower pressing body just before the commencement of the press-bonding of the adhesive tape and is reset to that position after the completion of the press-bonding, so as to prevent the matters such as water droplets or a part of the articles to be bound from attaching to the adhesive surface of the adhesive tape.

To explain this embodiment in more detail, referring to FIG. 24, a reference numeral 313 denotes a pair of brackets spaced from each other. As in the case of the embodiment shown in FIGS. 1 to 7, the cramping means 17,19, lower pressing body 15, suppressing plate 22 and other associated members are attached to this bracket 313. The tape adhesion device 35 is disposed in the same manner as the first embodiment shown in FIGS. 1 to 7.

In this case, an oscillating plate 321 is pivoted at its mid point to one side of the bracket 313 through a shaft 319. On an upper portion of the oscillating plate 321, provided is a cover plate 322 which covers upper portons of one of the cramping means, i.e. the holder 17 and the lower pressing body 15.

The oscillating plate 321 and the cover 322 constitute a drip-proof cover or a protective cover (referred to as water-proof cover, hereinafter) 320. The water protective cover 30 is urged clockwise as viewed in FIG. 24, by means of a spring 323. The bracket 313 is provided with a position restricting pin 324 which is adapted to stop the water-proof cover 320 when the end 322A of the cover plate 322 is positioned above the lower pressing body 15. As shown in FIG. 26, the end 322A of the cover plate 322 is so constructed that it contacts the outer adhesive surface of the single-side adhesive tape or the adhesive tape over the entire width of the latter. Preferably, gutters or conduits 322B for directing the water drops coming from the upper portion of the tape 6 to both sides of the pressing body 312 are formed in a "" shape in the vicinity of the cover 322. "" shape may be used in place of "" shape.

The arm support frame or the support body 106 pivotally carries an oscillation lever 36 at the mid point of the latter through a shaft 325. The lower end of the lever 326 is connected to the lower end of the lever 326 by means of a connecting rod 327. The binding arm 3 is provided with an operation pin 329 which is adapted to oppose the side surface of upper end of the oscillation lever 326 with a gap 328 preserved therebetween. This operation pin 329 is adapted to contact the side surface of upper end of the oscillation lever 326 when the binding arm 3 is swung down toward the base 1, before the press-bonding of the tape 6 is commenced. Thereafter, as the binding arm 3 is swung down, the oscillation lever 326 is rotated counter-clockwise as viewed in FIG. 27. As a result, the water-proof cover 320 is rotatively displaced from the position above the lower pressing body 15 at least to the position outside the holder 17 overcoming the force of the spring 323, and is reset to the position above the lower pressing body 15 by the force of the spring 323 when the binding arm 3 is raised.

In operation, for binding the articles A, the articles A are placed on the table 2 as shown by two-dot-and-dash line, while pressing the tape 6. Provided that the articles A are vegetables washed and cleaned, water droplets drop from the vegetable directly from the vegetable, or drips along the tape 6 when the latter is put in contact with the tape 6. However, since the water-proof cover 320 covers the upper side of the tape 6 on the lower pressing body 15, these water droplets are shielded by the protective cover 320 and do not attach to the bonding surface of the tape 6 on the lower pressing body.

Figure 27:
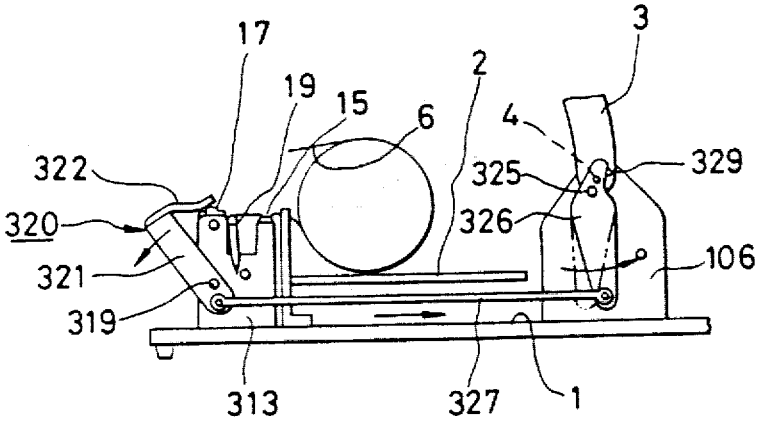
FIG. 27 is a side elevational view of the binding machine in the operating state.

Then, as the binding arm 3 is swung down onto the base 1, the tape 6 is rewound by a suitable amount by means of the reel rewinding means which is not shown in this drawing, and is wound around the articles A. In the state immediately before the bonding of the tape ends in which the upper pressing body 23 has been moved close to the lower pressing body 15, the oscillation pin 329 is brought into contact with the oscillation lever 326 and, then, the waterproof cover 320 is moved to the position out of the holder 17 as shown in FIG. 27, in accordance with the lowering of the binding arm 3. Subsequently, the wound portions of the tape are bonded together by a cooperation of the upper and lower pressing bodies 23 and 15, and the gap between two tape portions between the press-bonded portion of the tape and the articles is filled up and extinguished by means of a tape adhesion device which is not shown. Subsequently, the press-bonded end of the tape 6 is cut by means of the cutting edge. After the completion of the press-bonding, new end of the tape 6 is cramped between the holder 17 and the cramping rod 19, when the binding arm 3 is lifted upward. Also, as the binding arm 3 is lifted, the water-proof cover 320 is reset to the position above the base 1, by the force of the spring 323.

In the illustrated embodiment, the operation timing of the water-proof cover 320 is adjusted by preserving a play or gap 328 between the oscillation lever 326 and the operation pin 329. This arrangement, however, is not exclusive and it is possible to provide other adjusting means between the oscillation lever 326 and the operation pin 320.

Figure 28:
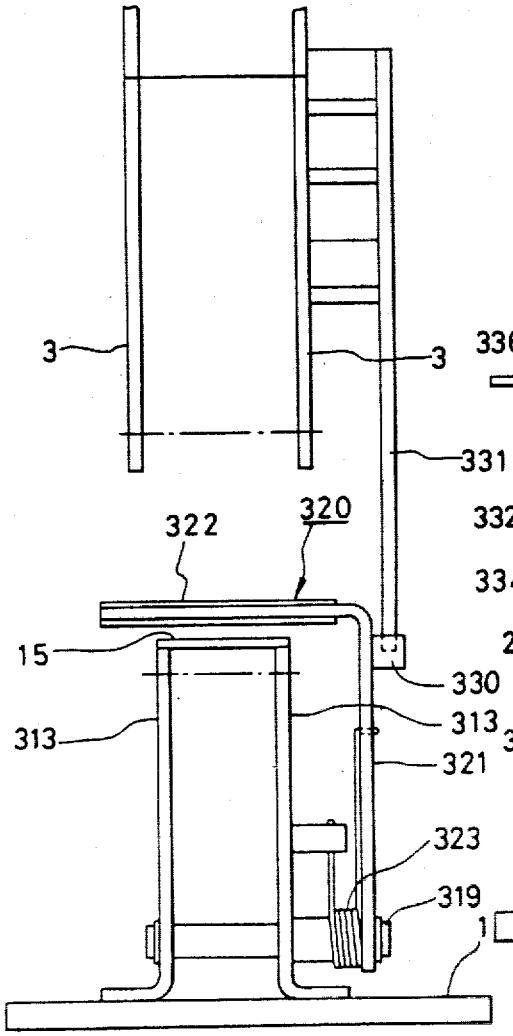
FIG. 28 is a side elevational view of an essential part of a binding machine which is a still further embodiment of the invention.
Figure 29:
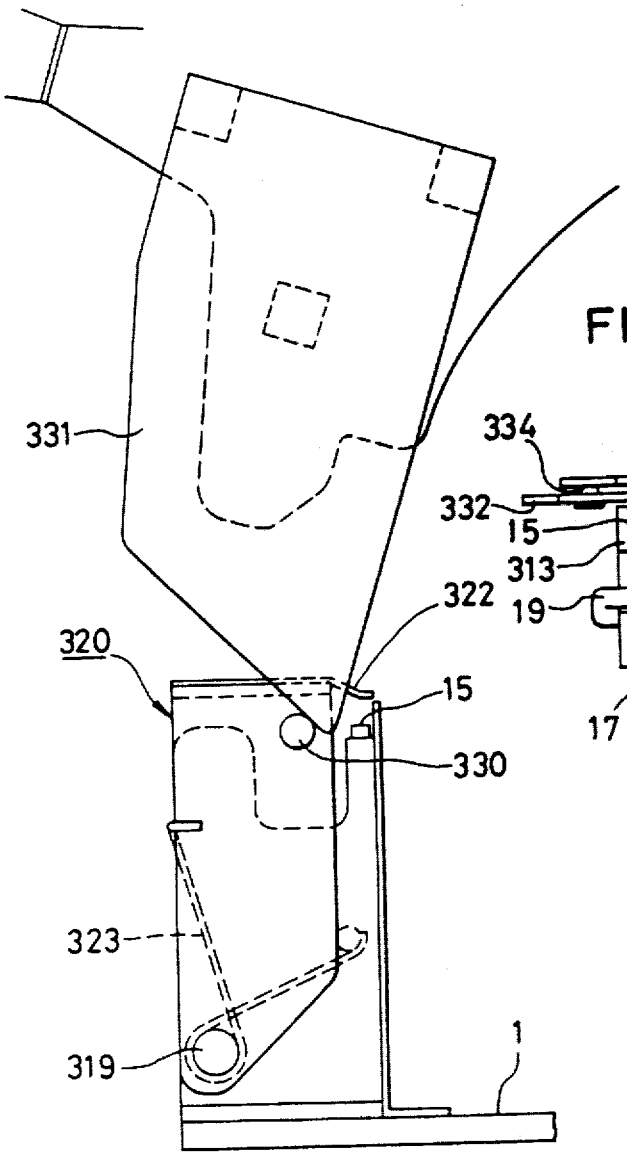
FIG. 29 is a front elevational view of an essential part of the binding machine shown in FIG. 28.

Insteadly of using the oscillation frame 326, connecting rod 327 and so forth, it is possible to provide a roller or a pin 330 on the water-proof cover 320, while providing the tip portion of the binding arm 3 with a cam plate 331 adapted to act on the roller or the pin 330 to swing and move the water-proof cover 320, as shown in FIGS. 28 and 29.

Figure 30:
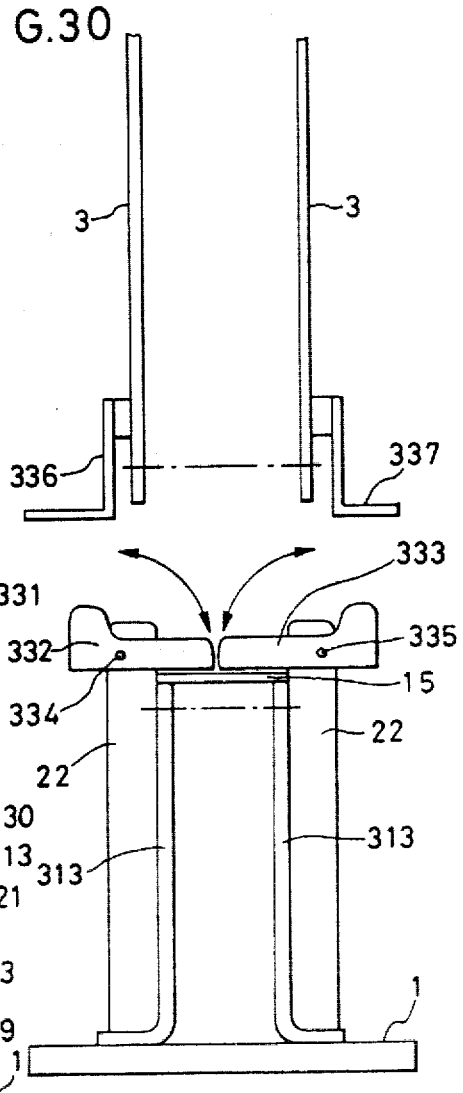
FIG.30 is a side elevational view of a binding machine which is a still further embodiment of the invention.
Figure 31:
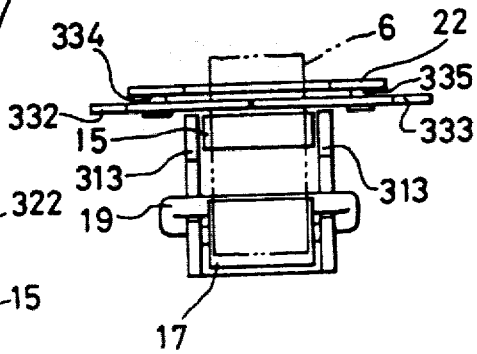
FIG. 31 is a plan view of the binding machine shown in FIG. 30.

FIGS. 30 and 31 show a modification of the protective cover 320. In this case, a left and a right cover plates 332,333 constituting a pair are pivoted at their intermediate portions to both sides of the lower pressing body 15 by means of pins 334,335, such that the ends of the cover plates 332,333 are movable to the left and right positions above the lower pressing body 5. Operation members 336,337 for depressing the lower ends of the cover plates 332,333 are fixed to or resiliently supported by both sides of the tip portion of the binding arm 3.

According to this example, the stroke of the cover plates 332,333 for opening and closing movement is diminished to afford a prompt operation of the cover plates.

FIG. 32A shows a modification of the tape cramping means and associated parts of the invention. In this case, the same tape adhesion device as that of the first embodiment shown in FIGS. 1 to 7 is used, but is neglected from FIG. 32A. The cramping device of this modification is adapted to leave the lower pressing body releasing the tape end and to be reset to the position near the lower pressing body after cramping the new cut end of the tape.

More specifically, a pressing body 23 engageable with the lower pressing body 15 is provided on the binding arm 3 for free forward and backward movement, and is urged toward the base 1 by means of the spring 23A. At the outside of the pressing body 23, a tape cutting edge 33 is fixed to the binding arm 3. A support member 412 having a tape-pressing roller 411 is provided at the outside of the cutting edge 33, and is urged by a spring 413 toward the base 1. At the inside of the roller 411, disposed is a tape pushing lever 414 which is pivoted at its base end to the support member 412. The tip portion of the tape pushing lever 414 is urged outwardly by means of the spring 415.

At the outside of the lower pressing body 15, an oscillation frame 416 is pivoted at its lower end to the base 1 through a shaft 417. The upper part of the oscillation frame 46 is movable toward and away from the lower pressing body 15, and is urged toward the latter by means of a spring 418.

A tape cramping rod 419 constituting one of the pair of tape cramping means is horizontally fixed to an upper part of the oscillation frame 416. At the same time, a shaft 420 carried by an oscillation frame 416 is disposed below the cramping rod 419. A tape cramping lever 421 constituting the other of the pair of tape cramping means is pivotally carried at its intermediate portion by the shaft 420. At the same time, the cramping lever 421 is urged toward the cramping rod 419 by means of a spring 422. A recess 423 engageable with the cramping rod 419 is formed at the position abutting the cramping rod 419, of the cramping lever 421. The end of the tape 6 is cramped between the bottom of the recess 423 and the cramping rod 419.

A stopper pin 424 is fixed to the outside of the cramping lever 421.

At the outside of the stopper pin 424, a shaft 425 is carried by the base 1 to extend substantially in parallel with the pin 424. A stopper rod 426 having a tip portion adapted to contact the pin 424 is pivoted at its base portion to the shaft 425. A stopper pin 427 is fixed to the oscillation frame 416 so as to carry the lower side of the stopper rod 426 when the oscillation frame 416 takes the position close to the lower pressing body 15.

A cam roller 428 is rotatably carried by the upper part of the oscillation frame 416. Also, at the tip portion of the binding arm 3, formed is a cam surface 429. The cam surface 429 includes an inclined cam surface 429A adapted to displace the cam roller 428 to the outside of the pressing body 15 when the arm 3 is swung toward the base 1, and a vertical cam surface 429B for holding the cam roller 428 at the maximum displaced position.

In operation, before the commencement of the binding operation, the tip portion of the adhesive tape 6 extracted from the tip portion of the binding arm 3 in the elevated state is held by the cramping rod 419 and the cramping lever 421, and the upper part of the oscillation frame 416 is held in contact with the pressing body 15. The tip portion of the stopper rod 425 is kept in contact with the stopper pin 424 of the cramping lever 421.

For binding the articles A, the articles 6 are inserted inwardly through between the binding arm 3 and the base 1, pressing the tape from the outside, and is placed on the table. Subsequently, the binding arm 3 is rotated to wind the tape 6 around the articles A and the end portions of the tape wound round the articles A are press-bonded as shown in FIG. 32A by means of the lower and upper pressing bodies 15,23. Also, the clearance between the two tape portions is filled up and extinguished by means of an adhesion device which is not shown. Then, as the binding arm 43 is further rotated, the inclined surface 429A formed on the tip portion of the binding arm 3 presses the cam roller 428 on the oscillation frame 416 to cause a movement of the latter in the direction of the arrow F. In this state, since the stopper rod 426 abuts the stopper pin 424 attached to the cramping lever 421, the cramping lever 421 is rotated around the shaft 420 in the clockwise direction away from the cramping rod 419 to release the end of the tape, as the oscillation frame 416 moves in the direction of arrow F. In this state, the cramping rod 419 has been moved to a position away from the lower pressing body 15 to allow the end of the tape 6 to come to the outside through the gap between the rod 419 and the cramping lever 421. The displacement of the cramping rod 419 can be determined by the size of the inclined surface 429A.

Then, as shown in FIG. 32B, when the arm 3 is moved to a position where the vertical surface 429B of the binding arm 3 contacts the roller 128, the pushing rod 414 is pressed against the cramping lever 421 and, thereafter, the cutting edge 33 is moved into the space between the lower pressing body 15 and the cramping rod 419 to cut the tape 6 at a portion in the vicinity of point of press-bonded portion. In this embodiment, a tape supporting rod 416A is formed on the oscillation frame 416, while an escape rod 34 is provided on the binding arm 3. This escape rod 35 tightens the tape 6, when the latter is slacked between the lower pressing body 15 and the cramping rod 419, so that the cutting of the tape is made without substantial difficulty or problem.

After the cutting of the tape, as the binding arm 3 is further swung down, the pushing rod 414 comes into the recess 423 in the cramping lever 421 as shown in FIG. 32C, so that the cut end of the tape 6 is pulled into the space between the cramping rod 419 and the cramping lever 421. In this state, the stopper rod 426 is positioned as shown by two-dot-and-dash line. Subsequently, as the roller 411 presses the cramping lever 421 to slightly rotate the latter 421 clockwise around the shaft 420, the stopper pin 424 is moved away from the stopper rod 426 to allow the latter to drop (full-line position in the drawing), so that the cramping lever 421 tends to be reset to the position near the cramping rod 419 due to the force of the spring 422.

Then, as the binding arm 3 is raised, the roller 411 and the pushing rod 414 are lifted to bring the cramping lever 421 into engagement with the cramping rod 419 to cramp the tape end. Then, as the binding arm 3 is further raised, the cramping rod 419 is returned to the position shown in FIG. 32A, together with the oscillation frame 416, by the force of the spring 418. In this state, the stopper rod 426 is lifted by the supporting pin 427 and reset to the position shown in FIG. 32A.

This construction conveniently makes it possible to reduce the length of the cut end portion of the tape wound around the article, and to ensure a secure cramping of the cut end of the tape. It is therefore possible to fill up and extinguish the gap between the two tape portions between the press-bonded portion of the tape and the articles to be bound.

What is claimed is:

1. A binding machine comprising:

a base provided at its one end with a tape reel for an adhesive tape and at its other end with a tape cramping means for cramping the other end of said adhesive tape, said base being further provided at its central portion with a table for receiving articles to be bound;

a binding arm pivoted to a point on said base between said cramping means and said tape reel, said binding arm having guide means adapted to guide and introduce said adhesive tape extracted from said tape reel to a tip portion of said binding arm;

a pair of pressing bodies one of which being provided at the inside of said tape cramp means on said base, while the other on the tip portion of said binding arm, said pressing bodies being adapted to abut each other so as to pressbond said adhesive tape wound round articles;

a cutting edge disposed at the outside of said pressing body on said binding arm and adapted for cutting said adhesive tape at the outside of said pressing bodies;

cramp controlling means adapted for releasing said cramping means at the time of cutting of said adhesive tape;

a tape pushing lever disposed at the outside of said cutting edge on said binding arm and adapted for pushing a new tape end into said cramping means; and a tape rewinding means disposed between a pivot portion of said binding arm and a support shaft of said tape reel and adapted for imparting a rewinding torque to said tape reel when the binding arm is swung down to the side of the base.

2. A binding machine as claimed in claim 1, said binding machine further includes a tape adhesion means adapted for filling up and extinguishing a gap formed between two tape portions stretched between said pressing bodies and said articles.

3. A binding machine as claimed in claim 2, wherein said tape adhesion means includes an upper projecting member supported by said binding arm so as to be moved along the side surface of said pressing member on said base to a level below the upper end of said pressing body on said base, when said pair of pressing bodies press-bond the adhesive tape.

4. A binding machine as claimed in claim 2, wherein said tape adhesion means includes a lower projecting member disposed at one side of said pressing body on said base and adapted to project above and below said pressing body on said base along from the side surface of the pressing body on the side of said base to the side surface of the pressing body on the side of the binding arm, and a lever supported by said base and adapted to project said lower projecting member when pressed by said binding arm.

5. A binding machine as claimed in claim 2, wherein said tape adhesion means includes a lower cramping body disposed at one side of said pressing body on the side of said base and adapted to be moved toward the article to be bound when the lower cramping body is pressed by the binding arm, and an upper cramping member disposed at one side of the pressing body on the side of said binding arm at a position for engagement with said lower cramping body, said upper cramping body being adapted to abut said lower cramping body and to move together with said lower cramping body toward said articles in engagement with the lower cramping body when the lower cramping body moves.

6. A binding machine as claimed in any one of claims 1 to 5, wherein said tape rewinding means includes a rotary shaft mounted on said base and operatively connected to said binding arm so as to be rotated in connection with the operation of said binding arm, torque transmission means adapted for operatively connecting said rotary shaft and the support shaft of said tape reel for bringing them into and out of contact with each other, a cam mounted on said rotary shaft, and interruption control means operatively connected to said cam, said interruption control means being adapted to switch said torque transmission means into disconnected or separate condition when said binding arm is in an elevated state, and to switch said torque transmission means into torque transmitting condition when said binding arm starts to decline or swing downward.

7. A binding machine as claimed in claim 6, wherein said torque transmission means include a first pulley carried by said support shaft, a second pulley carried by said rotary shaft, and a belt loosely stretched between said first and second pulleys, while said interruption control means include a belt pressing member adapted for pressing and releasing said belt.

8. A binding machine as claimed in claim 7, wherein said belt pressing member is disposed for pressing said belt onto the outer peripheral surface of said second pulley.

9. A binding machine as claimed in claim 6, wherein said tape rewinding means include a first rotary body operatively connected to said binding arm;

a second rotary body operatively connected to said first rotary body and rotatably attached to the support shaft of said tape reel;

a cam unitarily provided on said first rotary body;

a slide body attached axially movably to said support shaft of said tape reel and having at its one end an engaging member which can mesh with the first rotary body; and a lever engaging at one end with said slide body and with said cam at its other end.

10. A binding machine as claimed in claim 9, wherein a one-direction clutch is interposed between the slide body and said support shaft.

11. A binding machine as claimed in any one of claims 1 to 5, wherein a protective cover is disposed in the vicinity of said pressing body on the side of said base, said protective cover being adapted to be moved away from said pressing body on said base before the press-bonding is commenced, and moved back to the position above said pressing body after the completion of pressing thereby to protect the bonding surface of said adhesive tape.

12. A binding machine as claimed in any one of claims 1 to 5, wherein said cramping means are operatively connected to said binding arm and adapted to move away from said pressing body on said base after releasing the end of said adhesive tape, and, after cramping a new cut end of said adhesive tape, moved back toward said pressing body in the direction of the vicinity of the pressing body.

* * * * *